US008384642B2

(12) United States Patent
Nishimura

(10) Patent No.: US 8,384,642 B2
(45) Date of Patent: Feb. 26, 2013

(54) SIGNAL LINE DRIVING DEVICE COMPRISING A PLURALITY OF OUTPUTS

(75) Inventor: Kouichi Nishimura, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 1101 days.

(21) Appl. No.: 12/314,585

(22) Filed: Dec. 12, 2008

(65) Prior Publication Data

US 2009/0160497 A1 Jun. 25, 2009

(30) Foreign Application Priority Data

Dec. 25, 2007 (JP) ..... 2007-332040

(51) Int. Cl.
*G09G 3/36* (2006.01)

(52) U.S. Cl. ..... 345/98; 345/96; 345/99; 345/204

(58) Field of Classification Search ..... 345/204, 345/87–103, 210–211; 327/108, 120
See application file for complete search history.

(56) References Cited

U.S. PATENT DOCUMENTS 6,864,873 B2 3/2005 Yamagata et al.
2005/0024315 A1* 2/2005 Yamagata et al. ..... 345/98
2005/0206629 A1* 9/2005 Tseng et al. ..... 345/204
2006/0109227 A1* 5/2006 Park ..... 345/98
2006/0227091 A1* 10/2006 Nohtomi et al. ..... 345/98
2008/0297449 A1 12/2008 Yamashita et al.

FOREIGN PATENT DOCUMENTS

CN 1877690 A 12/2006
JP 10-143116 A 5/1998
JP 2001-290123 A 10/2001
JP 2006-292807 10/2006
JP 2006-330550 A 12/2006
JP 2008-233123 A 10/2008

OTHER PUBLICATIONS

Chinese Office Action dated Feb. 29, 2012, with English translation.
Japanese Office Action dated May 31, 2012 with a partial English translation thereof.

* cited by examiner

*Primary Examiner* — Hong Zhou
(74) *Attorney, Agent, or Firm* — McGinn IP Law Group, PLLC

(57) ABSTRACT

A driving device that outputs signals of different polarities from plural output terminals includes: a first power source wire that connects power terminals of some of plural first output circuits each outputting a signal of one polarity and power terminals of some of plural second output circuits each outputting a signal of the other polarity; and a second power source wire that connects power terminals of the rest of the plural first output circuits and power terminals of the rest of the plural second output circuits, the second power source wire being different from the first power source wire.

12 Claims, 14 Drawing Sheets

FIG. 3

| POL | S1 | S2 | S3 | S4 | S5 | S6 | S7 | ... |
|---|---|---|---|---|---|---|---|---|
| H | - | + | - | + | - | + | - | ... |
| L | + | - | + | - | + | - | + | ... |
| H | - | + | - | + | - | + | - | ... |
| L | + | - | + | - | + | - | + | ... |
| H | - | + | - | + | - | + | - | ... |
| — | — | — | — | — | — | — | — | |

FIG. 4

| POL | S1 | S2 | S3 | S4 | S5 | S6 | S7 | ... |
|---|---|---|---|---|---|---|---|---|
| L | + | - | - | + | + | - | - | ... |
| H | - | + | + | - | - | + | + | ... |
| L | + | - | - | + | + | - | - | ... |
| H | - | + | + | - | - | + | + | ... |
| L | + | - | - | + | + | - | - | ... |
| — | — | — | — | — | — | — | — | |

FIG. 5

| POL | S1 | S2 | S3 | S4 | S5 | S6 | S7 | ... |
|---|---|---|---|---|---|---|---|---|
| L | - | - | + | + | - | - | ... | ... |
| H | + | + | - | - | + | + | ... | ... |
| L | - | - | + | + | - | - | ... | ... |
| H | + | + | - | - | + | + | ... | ... |
| L | - | - | + | + | - | - | ... | ... |
| — | — | — | — | — | — | — | | |

SIGNAL LINE DRIVING DEVICE COMPRISING A PLURALITY OF OUTPUTS

BACKGROUND OF THE INVENTION

1. Field of the Invention

The present invention relates to a signal line driving device and, more specifically, to a device for driving multiple signal lines such as image signal lines for a display device.

2. Description of the Related Art

A schematic view of a known driving device for driving multiple signal lines is disclosed in Japanese Patent Application Publication No. 2006-292807 (JP-A2006-29807), for example. In JP-A 2006-29807, according to data signals to be outputted from a data latch, according to data signals to be outputted from a data latch, each of positive gradation selectors SEL1, 3, etc. selectively outputs one voltage from a set of multiple positive voltages, or each of negative gradation selectors SEL2, 4, etc. selectively outputs one voltage from a set of multiple negative voltages. The voltages are then inputted respectively into amplifiers AMP1, 3, etc. for the positive gradation and amplifiers AMP2, 4, etc. for the negative gradation. These amplifiers output gradation output signals depending on the predetermined drive capabilities of the amplifiers, and the output signals are then supplied to output terminals S1, S2, etc. through switches SW11, etc. Here, the driving device is provided with the set of the positive voltages and the set of the negative voltages so as to be applied to a display device of alternate current drive type, as typified by a display device using liquid crystal materials, for example. More specifically, the set of the positive voltages are higher than a predetermined voltage ½AVDD, while the set of the negative voltages are lower than that. The amplifiers AMP1, 3, etc. for the positive gradation are arranged in parallel to an array of the output terminals S1, S2, etc., and commonly connected to a power source wire AVDD and a ground wire AGNDP that are extending along the array of the amplifiers AMP1, 3, etc. Similarly, the amplifiers AMP2, 4, etc. for the negative gradation are arranged to be parallel to the array of the output terminals and to be adjacent to the array of the amplifiers for the positive gradation in the back and forth direction, and are also commonly connected to the power source wire AVDDN and the ground wire AGND that are extending along the amplifiers AMP2, 4, etc. According to input from the selectors, the amplifiers for the positive gradation each generate a positive output signal that is higher than a reference voltage, while the amplifiers for the negative gradation each generate a negative output signal that is lower than the reference voltage. The switches SW11, etc perform a switchover between the positive and negative output signals to alternately output these signals from output terminals adjacent to each other. Consequently, the positive and negative output signals are alternately outputted from the output terminals S1, S2, etc.

According to a review of the inventor of this application, a drive circuit of JP-A 2006-29807 mentioned above has a risk that the output signals may be made unstable due to fluctuations in source voltages caused by resistance components of a power source wire connected to the amplifier. In other words, when an amplifier AMP1 supplies an output signal of positive gradation voltage to an output terminal S1, for example, a large current has to flow from the power source wire AVDD to the output terminal S1. In contrast, no current flows from the amplifier AMP1 to a ground wire AGNDP, or some transient current or some penetration current flows, depending on performance of the amplifier. This also applies to other amplifiers AMP3, 5, etc., for the positive graduation voltages. Thus, a large current from the power source wire AVDD in concentration is supplied to the AMP1, 3, 5, etc., and thereby causes a voltage drop in the power source wire AVDD. On the other hand, when an amplifier AMP2 supplies an output signal of negative graduation voltage to an output terminal S2, for example, a large current has to flow from the output terminal S2 to the ground wire VGND, while no or slight current flows from the power source wire AVDDN to the amplifier AMP2. This also applies to other amplifiers AMP4, 6, etc. for the negative graduation voltages. Thus, the currents from the AMP2, 4, 6, etc. concentrate on the ground wire AGND, and the large current causes a voltage rise in the ground wire AGND. As such, the voltage drop in the power source wire and the voltage rise in the ground wire occur and result in noise of the power source. Consequently, the output terminals S1, etc. output the output signals having unstable potentials. In particular, a device for driving signal lines of a display device such as an LCD driver or the like tends to have a larger and larger number of output signal lines. For example, the number of output signal lines is conventionally about 240 channels, but nowadays the number has increased to a maximum of 960 channels. Thus, in a configuration and layout of a circuit having multiple output amplifiers, the effect of a voltage drop due to resistance components of the power source wire is considered to be increasingly significant as the number of outputs increases.

SUMMARY OF THE INVENTION

In order to solve the problem, in a configuration according to claim 1 of this application, a drive circuit includes first output circuits that output signals of one polarity and second output circuits that output signals of the other polarity, and the drive circuit is configured such that a power source wire supplies power by being commonly connected to power terminals of some of the first output circuits and to power terminals of some of the second output circuits.

In such configuration, the first and second output circuits differ from each other in the polarity of the output signals, and thus one causes a large current to flow to or from the power source, while the other causes a small current to flow to or from the power source. Since the power source wire allows a current to flow to and from some of the first output circuits and some of the second output circuits, the power source wire can prevent a large current from concentrating and prevent output signals of the drive circuit from becoming unstable.

In addition, in a configuration according to claim 17, a drive circuit includes: plural output terminal units arranged in a predetermined direction; plural first output circuit units that output signals of one polarity; and second output circuit units that output signals of the other polarities, and the drive circuit is configured such that at least some of the first output circuit units and at least some of the second circuit units form a first array, and the rest of the first output circuit units and the rest of the second circuit units form a second array.

In such configuration, since the at least some of the first output circuit units and the at least some of the second output circuit units form the first array, and the rest of the first output circuit units and the rest of the second output circuit units form the second array, it is possible to prevent currents from concentrating on only a specific one of the arrays of amplifiers, and thus to prevent output signals from becoming unstable due to excessive consumption of currents.

According to the present invention, even in a drive circuit for driving multiple signal lines, fluctuations in a source voltage can be prevented and output signals can be prevented from becoming unstable.

BRIEF DESCRIPTION OF THE DRAWING

FIG. 3 is a view showing a frame format of dot inversion driving method that is a method of inverting polarities in the driving device according to the first embodiment.

FIG. 4 is a view showing a frame format of H2 dot inversion driving method that is a method of inverting polarities in the driving device according to the second embodiment.

FIG. 5 is a view showing a frame format of other aspects of the 2 dot inversion driving method.

BEST MODE FOR CARRYING OUT THE INVENTION

Embodiments of the present invention will be described hereinafter with reference to the accompanying drawings. Any of the following descriptions is simply an example, and thus shall not limit the present invention. In addition, those skilled in the art could understand and execute a modification or an addition to the embodiment without departing from the scope of claims.

First Embodiment

Figure 1:
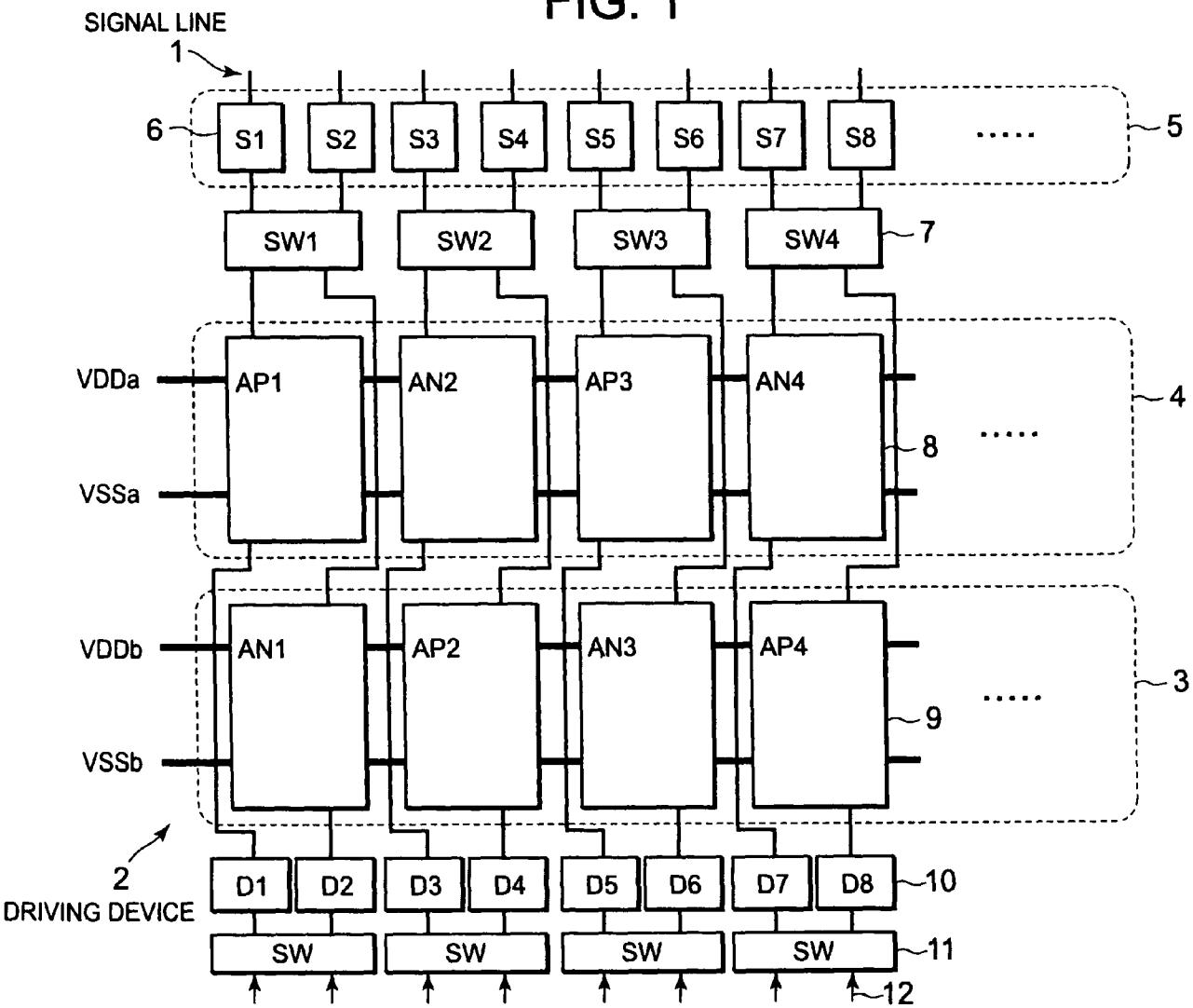
FIG. 1 is a schematic layout diagram of a driving device of P/N buffer amplifier type according to the first embodiment.

FIG. 1 is a block diagram showing an outline of a signal line driving device 2.

Multiple output terminals 6 are respectively connected to multiple signal lines 1 to be driven. The output terminals 6 are adjacent to each other and constitute an array 5 extending in a horizontal direction in FIG. 1. In FIG. 1, of the multiple output terminals 6, eight are exemplified, each being designated S1 to S8. But the device may be formed of a greater or smaller number of the output terminals, if it is plural.

Amplifiers AP1 and AN1 for output are connected to output terminals S1 and S2 through a switch 7. The amplifier AP1 is an amplifier for generating a positive polarity output signal, connected to a power source wire VDDa that supplies source voltage VDD and a power source wire VSSa that supplies a ground potential VSS, and generates an output signal within a range from ½VDD (meaning ½ of VDD. Same in the following) to VDD. The amplifier AN1 is an amplifier for generating a negative polarity output signal, connected to a power source wire VDDb that supplies source voltage VDD and a power source wire VSSb that supplies the ground potential VSS, and generates an output signal within a range from the ground potential to ½VDD. A configuration of the driving device that uses a dedicated amplifier AP1, etc., that outputs a voltage on a more positive side than an intermediate voltage that serves as a reference (½VDD to VDD) and a dedicated amplifier AN1, etc. that outputs a voltage on a negative side (VSS to ½VDD) is referred to as a configuration of P/N buffer amplifier type. In this case, each amplifier cannot switch the polarity and output the signal, and the switch 7 for switching the polarity of an output signal is located on a back step of the amplifier.

As its operation is described below in detail, upon receipt of a polarity inversion signal POL, the switch 7 connects the amplifiers AP1 and AN1 to the output terminals S1 and S2, respectively, in one operation cycle, while switching the connection state to connect the amplifier AP1 and AN1 to the output terminals S2 and S1, respectively, in another operation cycle when the polarity inversion signal changes its logical value. Here, a normal order connection aspect denotes a case where each of the switches 7 receives two signals from the amplifiers and connects the two signals to two corresponding output terminals without interchanging the two signals in their order. On the other hand, an interchanged connection aspect denotes a case where each of the switches 7 interchanges the two signals and thus connects the two signals in a crossing manner to the two corresponding output terminals.

Figure 7A:
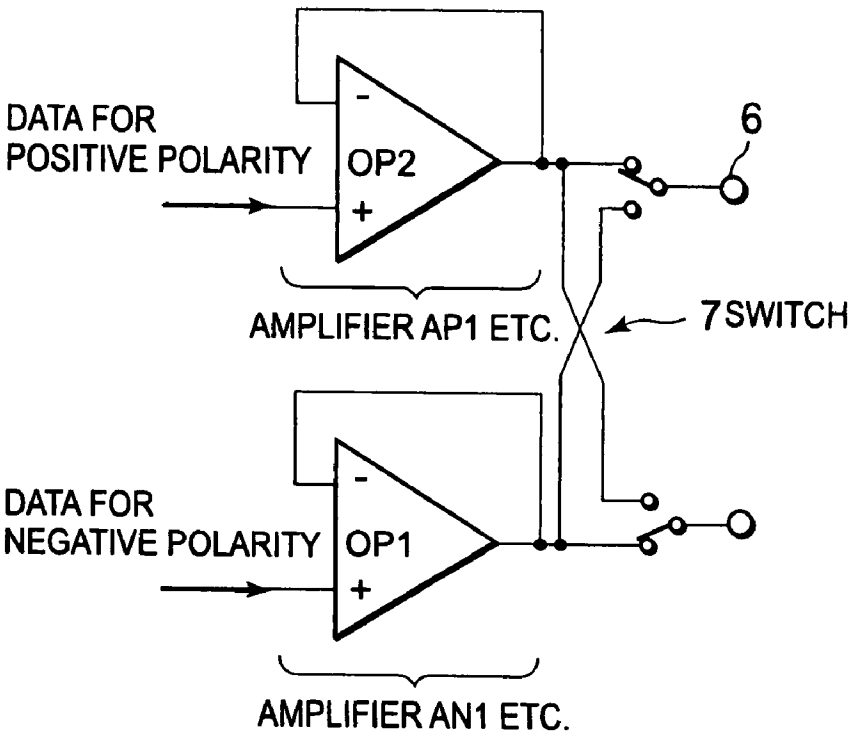
FIGS. 7A and 7B are schematic views comparing and describing the P/N buffer amplifier type with the rail-to-rail amplifier type.

FIG. 7A shows a configuration of a drive circuit of such the P/N buffer amplifier type, extracting an area of the amplifier and the switch. The amplifier AN1, etc. for negative polarity is configured to receive an input signal at a positive input end of a differential amplifier OP1, and an output end thereof is connected to a negative input end forming a negative feedback connection. Similarly, the amplifier AP1, etc., for positive polarity is configured to receive an input signal at a positive input end of a differential amplifier OP2 and an output end thereof is connected to a negative input end forming a negative feedback connection. The switch 7 is connected to the back step of the amplifiers AP1 and AN1, outputs are changed, as appropriate, and connected to the output terminals 6.

Amplifiers AP2 and AN2 for output are connected to terminals S3 and S4 through the switch 7. The amplifier AP2 is an amplifier for generating a positive polarity output signal, connected to the power source wire VDDb that supplies source voltage VDD and the power source wire VSSb that supplies the ground potential VSS, and generates an output signal within a range from ½VDD to VDD. The amplifier AN2 is an amplifier for generating a negative polarity output signal, connected to the power source wire VDDa that supplies the source voltage VDD and the power source wire VSSa that supplies the ground potential VSS, and generates an output signal within a range from the ground potential to ½VDD.

Similar to the above, upon receipt of a polarity inversion signal (not shown), the switch 7 corresponding to the output terminals S3 and S4 connects the amplifiers AP2 and AN2 to the output terminals S3 and S4, respectively, in one operation cycle, and in other operation cycle, when the polarity inversion signal changes its logical value, the switch 7 is switches the connection state and connect the amplifier AP2 and AN2 to the output terminals S3 and S4, respectively.

Also output terminals S5 to S8 are similarly configured in an aspect in which the switch 7 and amplifiers AP3, AP4, AN3, and AN4 repeat the configuration corresponding to the output terminals S1 to S4.

Then, out of the amplifiers corresponding to the output terminals S5 and S6, the amplifier AP3 is an amplifier for generating a positive polarity output signal and connected to the power source wire VDDa and VSSa. The amplifier AN3 is an amplifier for generating a negative polarity output signal, and connected to the power source wires VDDb and VSSb. In addition, out of the amplifiers corresponding to the output terminals S7 and S8, the amplifier AP4 is an amplifier for generating a positive polarity output signal, and connected to the power source wires VDDb and VSSb. The amplifier AN4 is an amplifier for generating a negative polarity output signal and connected to the power source wires VDDa and VSSa.

A signal processing circuit 10 gives a data signal to each amplifier. In FIG. 1, the signal processing circuits corresponding to the exemplified eight amplifiers are denoted as D1 to D8, respectively. Upon receipt of respective input data signals 12, the signal processing circuits 10 each execute necessary signal processing such as level shift or D/A conversion and the like, and supply an input signal to the amplifier AP1, etc. The signal processing circuits D1, D3, D5 and D7 execute processing of positive polarity signals, and the signal processing circuits D2, D4, D6 and D8 execute processing of negative polarity signals.

A switch 11 is provided in the front step of the signal processing circuits 10 and is configured such that adjacent ones of the signal processing circuits 10 mutually change input terminals thereof and receive input data signals 12. The switch 11 performs the switching operation in response to a polarity inversion signal. This enables the switch 11 to similarly interchange the order of data signals 12 in advance, in response to the switch 7 exchanging, as appropriate, outputs of the amplifier AP1, etc. and interchanging polarities of signals to be outputted from the output terminal S1, etc. Thus, output signals corresponding to the data signals 12 are supplied to the output terminals S1 to S8 in the correct order in final state.

In the driving device as shown in FIG. 1, amplifiers are arranged in each of two arrays consisting of arrays 3 and 4. In fact, the amplifiers AP1, AN2, AP3 and AN4 are arranged adjacent to each other to form the array 4, while the amplifiers AN1, AP2, AN3 and AP4 are arranged adjacent to each other to form the array 3. The arrays 3 and 4 of these amplifiers are arranged adjacent to each other and also adjacent to the array 5 of the output terminals 5. Each amplifier 8 belonging to the array 4 and each amplifier 9 belonging to the array 3 may be adjacent to each other in a direction orthogonal to a direction in which the array 5 extends, i.e., right and left directions of the figure. FIG. 1 shows such the case in which the amplifiers AP1 and AN1 are mutually adjacent in the up and down direction of the figure. However, for the sake of convenience of the layout, a positional relationship between each pair of the amplifiers 8 and 9 can be adjusted so that they are slightly misaligned in the right and left direction, as appropriate, and it would be acceptable if the amplifiers 8 and 9 are aligned side by side in a predetermined direction that is different from the direction of the array 5.

The pair of power source wires VDDb and VSSb as already mentioned and another pair of the power source wires VDDa and VSSa are provided for the arrays of amplifiers 3, 4, respectively. The amplifiers 9 belonging to the array 3, namely, the amplifiers AN1, AP2, AN3, AP4, etc. are commonly connected to the pair of the power source wires VDDb and VSSb, and thus commonly receive supply of power. Meanwhile, the amplifiers 8 belonging to the array 4, namely, the amplifiers AP1, AN2, AP3, AN4, etc. are commonly connected to the pair of the power source wires VDDa and VSSa and commonly receive supply of power. Although both the power source wires VDDa and VDDb are wires for supplying the source supply VDD, they are independently provided, corresponding to the arrays 4 and 3, respectively, not interconnected within the arrays, and extend in parallel to the arrays 3, 4, 5. Similarly, although both the power source wires VSSa and VSSb supplies the ground voltage VSS, they are independently provided, corresponding to the arrays 4 and 3, not interconnected within the arrays, and extend in parallel to the arrays 3, 4, 5.

Figure 2B:
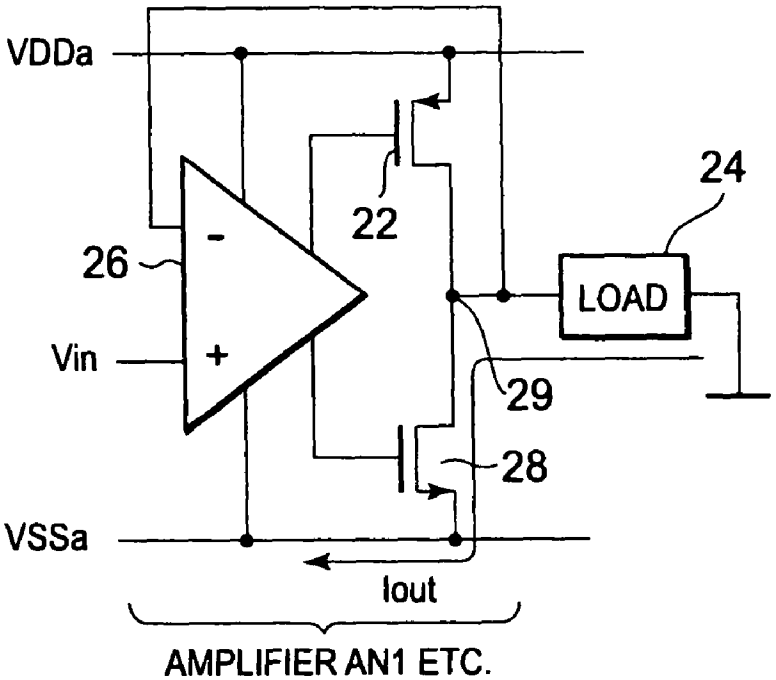
FIGS. 2A and 2B are a circuit diagram of a P/N buffer amplifier and a view showing a frame format of a current path.
Figure 2A:
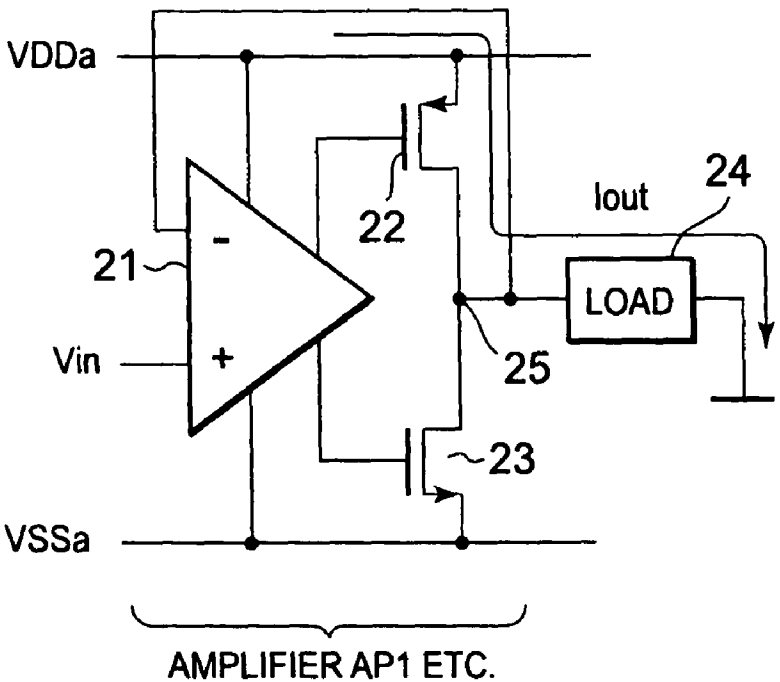

FIG. 2A is a schematic circuit diagram showing a configuration of the positive polarity amplifiers AP1 and AP3, etc., out of the amplifiers belonging to the array 4 of the driving device 2. Also for the positive polarity amplifiers AP2 and AP4 belonging to the array 3, the same would apply if the power source wires in the figure were replaced by VDDb and VSSb.

In FIG. 2A, an input signal Vin is a signal to be received from the signal processing circuit 10 and supplied to a positive input terminal of a differential amplifier step 21. Outputs of the differential amplifier step 21 are connected to gate polarities of P-type transistor 22 and N-type transistor 23. The transistors 22 and 23 are connected in series between the pair of the power source wire VDDa and VSSa and used as output transistors. A common connecting node 25 of the transistors 22 and 23 is an output end of each of the amplifiers AP1 and AP3, etc. The output end 25 is connected to a negative input terminal of the differential amplifier step 21 and constitutes a feedback circuit. The differential amplifier step 21 drives a gate of the P-type transistor 22 at a voltage level reflecting a value of an input signal Vin. Consequently, output voltage is appropriately generated within the voltage range of ½VDD to VDD to the output end 25.

The output end 25 is connected to a signal line 1 to be driven through the switch 7 and the output terminal S1. In FIG. 2A, the switch 7 and the output terminal S1, etc. are omitted, and a load 24 on the signal line 1 is shown. Although various loads can be considered for the load 24, depending on use of the drive circuit, it can be applied to a signal line of a liquid crystal display device and pixels connected thereto. As such, if the driving device of this embodiment is used as a so-called LCD driver, the load 24 is parasitic capacitance of a signal line in the display device and a capacitative element having liquid crystal materials constituting pixels as a dielectric material.

FIG. 2B is a schematic circuit diagram showing a configuration of the negative polarity amplifier AN2 and AN4, etc. among the amplifiers belonging to the array 4 of the driving device 2. Also for the negative polarity amplifiers AN1 and AN3 belonging to the array 3, the same would apply if the power source wires in the figure were replaced by VDDb and VSSb.

In FIG. 2B, an input signal Vin is a signal to be received from the signal processing circuit 10, which is then supplied to a positive input terminal of a differential amplifier step 26. Outputs of the differential amplifier step 26 are connected to gate polarities of P-type transistor 27 and N-type transistor 28. The transistors 27 and 28 are connected in series between the pair of the power source wires VDDa and VSSa, and a common connecting node 29 of the transistors 27 and 28 is an output end of the amplifiers AN2 and AN4, etc. The output end 29 is connected to the negative input terminal of the differential amplifier step 26 and constitutes a feedback circuit. The differential amplifier step 26 drives a gate of the N-type transistor 28 at a voltage level reflecting a value of the input signal Vin. Consequently, output voltages is appropriately generated within the voltage range from the ground potential to ½VDD to the output end 29.

The load 24 connected to the output end 29 is similar to FIG. 2A.

Next, an operation of the driving device will be described hereinafter. First, in a condition in which a polarity inversion signal takes a logical value H and the switch 7 is switching according to the polarity inversion signal, the output terminals S1, etc., and the amplifiers AP1, etc., are connected correspondingly as shown below, via the switches 7:

A correspondence relation of the output terminal and the amplifier when the polarity inversion signal is H shall be as follows:

| Output Terminal | S1 | S2 | S3 | S4 | S5 | S6 | S7 | S8 |
|---|---|---|---|---|---|---|---|---|
| Amplifiers | AN1 | AP1 | AN2 | AP2 | AN3 | AP3 | AN4 | AP4 |

In other words, in terms of the connection aspect of the switch 7, the switches SW1 and SW3 are in the interchanged connection aspect, while the switches SW2 and SW4 are in the normal order connection aspect.

As the amplifiers AP1, AP2, AP3, and AP4 are an amplifier for generating a positive polarity output signal, and the amplifiers AN1, AN2, AN3, and AN4 are an amplifier for generating a negative polarity output signal, in the case described above, the output terminals S1 to S8 alternately generate signals having different polarities.

Then, when the polarity inversion signal changes its logical value to L, and the switch 7 switches, a connection relationship between the output terminals and amplifiers shall be as follows.

A correspondence relation of the output terminal and the amplifier when the polarity inversion signal is L:

| Output Terminal | S1 | S2 | S3 | S4 | S5 | S6 | S7 | S8 |
|---|---|---|---|---|---|---|---|---|
| Amplifiers | AP1 | AN1 | AP2 | AN2 | AP3 | AN3 | AP4 | AN4 |

In other words, in terms of the connection aspect of the switch 7, the switches SW1 and SW3 change to the normal order connection aspect, while SW2 and SW4 change to the interchanged connection aspect.

In other words, in this example, the configuration is such that output signals from the output terminals S1, etc. are generated with their polarities not only being alternately inverse but also inversed in terms of time. FIG. 3 schematically shows this condition. In the table of FIG. 3, the horizontal axis represents output terminals, and symbols + and − in the table represent that polarities of an output signals are positive and negative, respectively. The vertical axis of the table shows how values of the polarity inversion signal POL vary. This is an applicable output method for preventing any burn-in or flickering of the screen of a liquid crystal display. In particular, when the polarity inversion signal POL is inversed for every horizontal display period of a display device, the polarity in Table 3 corresponds to arrangement of polarity of every pixel in the screen of the display device. This method is referred to as a dot inversion method wherein pixels of different polarities are arranged in a checkered pattern, thereby improving picture quality.

As such, when the polarity inversion signal POL changes from H to L, in this new operation cycle, the amplifier AP1, for example, has to drive, to a predetermined potential within the range from ½VDD to VDD, the output terminal S1 that was driven by the negative polarity amplifier AN1 to the potential from the ground potential to ½VDD in the previous operation cycle and its accompanying signal line 1 and load 24. This generates a large current output Iout. FIG. 2A is now referred to in order to describe this. FIG. 2A shows the operation of AP1 in this case. To drive the signal line 1 and its load 24 with a positive polarity output signal, the amplifier AP1 takes in a relatively large current from the power source wire VDDa and output it to the output terminal S1. In the output amplifier AP1, either there is no current flowing from the output terminal S1 to the power source wire VSSa of the ground potential, or there is only some transient current or some penetration current at steady time.

Similarly, each of the positive polarity amplifiers AP2, AP3, and AP4 takes in a relatively large current from the power source potential VDD, and output to each of the output terminals S3, S5, and S7. Thus, a sum of the currents that all of the positive polarity amplifiers should flow from the power source potential VDD is large. As described above, in the drive circuit 2, however, the amplifiers of positive polarity are divided into two groups so that the pairs of the power source wires differ. The power source wire VDDa, for example, is commonly connected to some of the positive polarity amplifiers, i.e., AP1 and AP3, etc. and thus independent of others, i.e., AP2 and AP4, etc. Thus, even when the positive polarity amplifiers AP1 and AP3, etc. operate simultaneously, current to run through the power source wire VDDa can be kept low, thereby enabling stable maintenance of the potential VDD of the power source wire VDDa. Hence, outputs from the amplifiers AP1 and AP3, etc., do not oscillate due to fluctuations in the power source potential.

Similarly, other power source wire VDDb is also commonly connected to some of the positive polarity amplifiers, i.e., AP2 and AP4, etc. and independent of others, i.e., AP1 and AP3, etc. Thus, even when the positive polarity amplifiers AP2 and AP4, etc. operate simultaneously, current to run through the power source wire VDDb can be kept low, thereby enabling stable maintenance of the potential VDD of the power source wire VDDb. Hence, outputs from the amplifiers AP2 and AP4, do not oscillate due to fluctuations in the power source potential.

In addition, in this operation cycle, the amplifier AN2, for example, has to drive, to a predetermined potential within the range from the ground potential to ½VDD, the output terminal S4 that was driven to the potential from ½VDD to VDD by the positive polarity amplifier AP2 in the previous operation cycle and its accompanying signal line 1 and the load 24. This generates a large negative current output Iout. In fact, in this case, the operation of taking in the current from the signal line 1 and flowing it into the ground power source wire is performed. FIG. 2B is referred to in order to describe this. FIG. 2B shows the operation of AN2 in this case. To drive the signal line 1 and its load 24 with a negative polarity output signal, the amplifier AN2 takes in a relatively large current from the output terminal S4 and output it to the power source wire VSSa of the ground potential. In the output amplifier AN2, either there is no current flowing from the power source wire VDDa to the output terminal S4, or there is only some transient current or some penetration current at steady time.

Similarly, each of the negative polarity amplifiers AN1, AN3, and AN4 takes in a relatively large current from the signal line 1 and discharge it to the respective power source wires of ground potential. Thus, a sum of the current that all the negative polarity amplifiers are to flow to the ground potential is large. As described above, in the drive circuit 2, however, the amplifiers of negative polarity are divided into two groups so that the pairs of the power source wires differ. The power source wire VSSa of the ground potential, for example, is commonly connected to some of the negative polarity amplifiers, i.e., AN2 and AN4, etc. and thus independent of others, i.e., AN1 and AN3, etc. Thus, even when the negative polarity amplifiers AN2 and AN4, etc. operate simultaneously, current to run through the power source wire VSSa can be kept low, thereby enabling stable maintenance of the ground potential VSS of the power source wire VSSa. Hence, outputs from the amplifiers AN2 and AN4, etc., do not oscillate due to fluctuations in the power source potential.

Similarly, other power source wire VSSb is also commonly connected to some of the negative polarity amplifiers, i.e., AN1 and AN3, etc. and independent of others, i.e., AN2 and AN4, etc. Thus, even when the negative polarity amplifiers AN1 and AN3, etc. operate simultaneously, current to run through the power source wire VSSb can be kept low, thereby enabling stable maintenance of the potential VSS of the power source wire VSSb. Hence, outputs from the amplifiers AN1 and AN3, etc., do not oscillate due to fluctuations in the power source potential.

The driving device 2 can be configured on a silicon substrate as a semiconductor integrated circuit, cut out as a chip, and connected to a signal line to be driven. Or when it is used as a driving device for a display device, it can be formed directly in the periphery of the screen of the display device by using SOG technology in which a circuit is formed on a surface of an insulator such as a glass by using semiconductor material, insulating material, and metal material, as appropriate. In particular, the driving device of this embodiment can prevent concentration of power current, thereby preventing a resistance of a power source wire from causing unstable output signals. Thus, it can also be applied to formation of a circuit in the periphery of the display device with the SOG method where the circuit tends to have a larger wiring resistance. In addition, according to the device of this embodiment, the amplifiers that operate under the same power source potential and ground potential are adopted as each amplifier of positive polarity and negative polarity. Thus, any fluctuation in output characteristics due to use of different power sources for each amplifiers of positive polarity and negative polarity can be prevented.

Second Embodiment

Next, as an example of a second embodiment, a configuration using an inversion driving method may be possible wherein polarity of an output signal is interchanged for every two output terminals. Similar to FIG. 3, FIG. 4 shows how polarity of output signals varies in that case. In FIG. 4, in the array 5 of output terminals, polarity of those at the end, i.e., polarity of the output terminal S1 differs from that of the output terminal S2. The output terminals S2 and S3 have mutually identical polarities, being opposite to that of the output terminal S1. The output terminals S4 and S5 have mutually identical polarities, being opposite to those of the output terminals S2 and S3, and so on. As such, this is the method wherein polarities change for every two output terminals subsequently. Such the configuration of output signals may be adopted when consideration is given to picture quality or power consumption, etc. of a display device, for example. As such, the driving method in which output signals change polarities for every two adjacent terminals is referred to as H2 dot inversion driving.

Thus, in order to make the arrangement whereby polarities are inversed for every two output terminals, in the driving device 2 of this application, for example, the connection aspect in which the switch 7 switches depending on a polarity inversion signal POL is changed. In other words, the configuration of the switches SW2 and SW4, etc. is changed from the case of the first embodiment described above, so that all of the switches SW1 to SW4, etc. is in normal order when the polarity inversion signal is L, and in reverse order when the polarity inversion signal is H. In that case, a correspondence relationship between the output terminals and the amplifiers shall be as follows:

A correspondence relationship between the output terminals and the amplifiers when the polarity inversion signal is H:

| Output Terminal | S1 | S2 | S3 | S4 | S5 | S6 | S7 | S8 |
|---|---|---|---|---|---|---|---|---|
| Amplifiers | AN1 | AP1 | AP2 | AN2 | AN3 | AP3 | AP4 | AN4 |

A correspondence relationship between the output terminals and the amplifiers when the polarity inversion signal is L:

| Output Terminal | S1 | S2 | S3 | S4 | S5 | S6 | S7 | S8 |
|---|---|---|---|---|---|---|---|---|
| Amplifiers | AP1 | AN1 | AN2 | AP2 | AP3 | AN3 | AN4 | AP4 |

Or, the switches of the first embodiment as described above may be used by giving a complementary signal/POL for the polarity inversion signal POL to the switches SW2 and SW4, etc., i.e., even numbered switches. In addition, the first embodiment and the second embodiment as described above may be implemented within the same driving device 2 by switching them, as appropriate, through mode switching. In that case, depending on a mode switching signal, it may be switched whether to supply to the even-numbered switches 7 with polarity inversion signal POL or with /POL, the inversed signal of POL, while the polarity inversion signal POL is being supplied to the odd-numbered switches 7.

Third Embodiment

Figure 6:
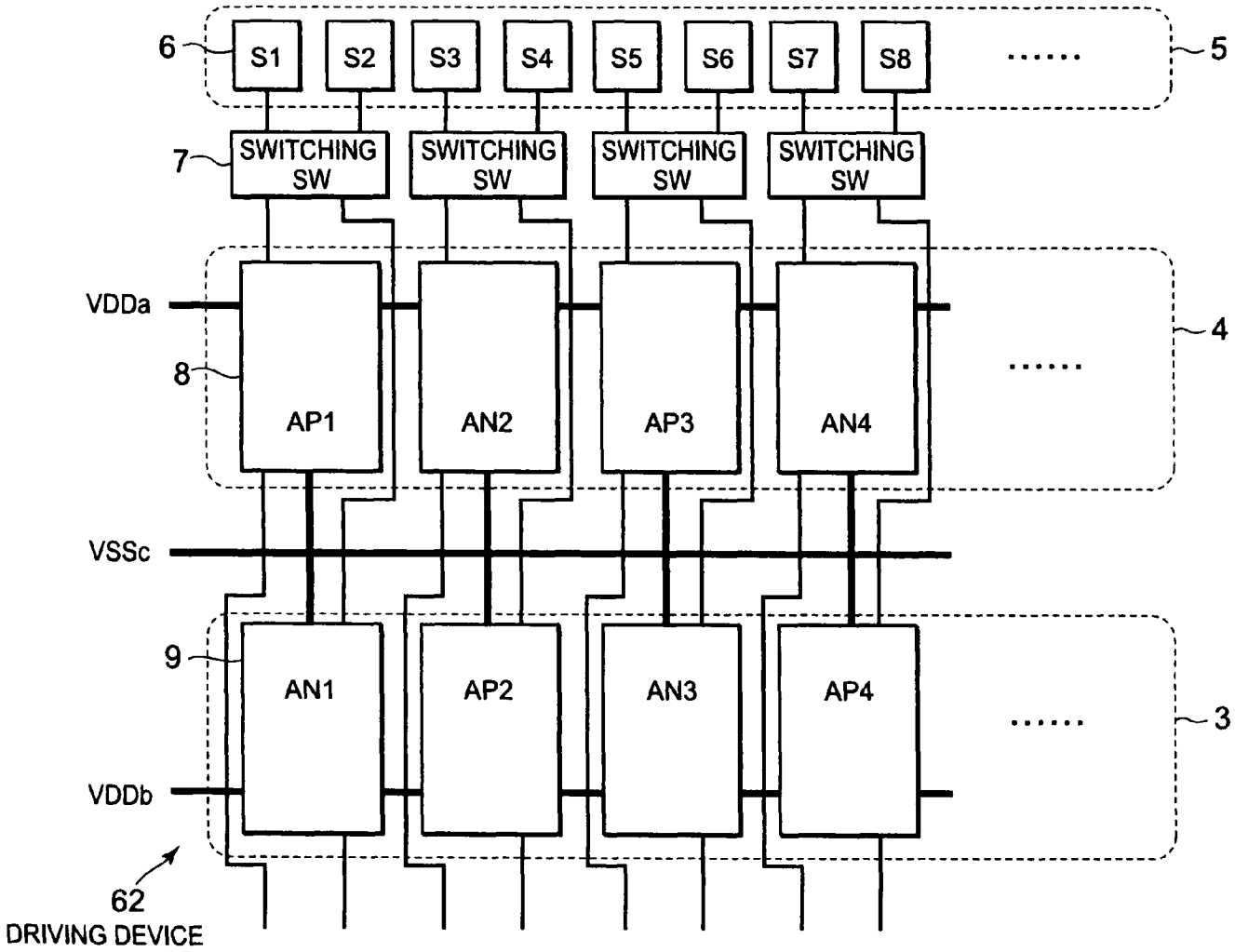
FIG. 6 is a schematic view showing a third embodiment.

FIG. 6 is a schematic view of a driving device showing a third embodiment. Although a signal processing circuit 10 and a switch 11 are omitted, they are similar to those in the first and second embodiments. A different point from the first and second embodiments is that a power source wire VSSc of a ground potential is provided, and commonly connected to the arrays 3 and 4 of the amplifiers, in order to supply a power source of the ground potential. The configuration in this manner enables a power source wire VSSc to be formed thicker by providing some extra area between the arrays of the amplifiers 3 and 4. Thus, even when the negative polarity amplifiers AN1 and AN3, etc. belonging to the array 3 and the negative polarity amplifiers AN2 and AN4, etc. of the array 4 are commonly connected to this power source wire VSSc, any fluctuation in the potential can be prevented. Meanwhile, similar to the first and second embodiments, as the power source wires VDDa and VDDb correspond to the array 4 and array 3, respectively, and independently supply the power source potential to each array. Accordingly, fluctuations in the power source potential can be prevented and thus fluctuation in the output signals can be prevented. In other words, even where there is no extra area such as the power source wire VSSC and resistance cannot be lowered by thickening a wire, the potential fluctuations in the power source wires VDDa and VDDb can be prevented, thereby enabling maintenance of stable output signal.

Fourth Embodiment

Figure 7B:
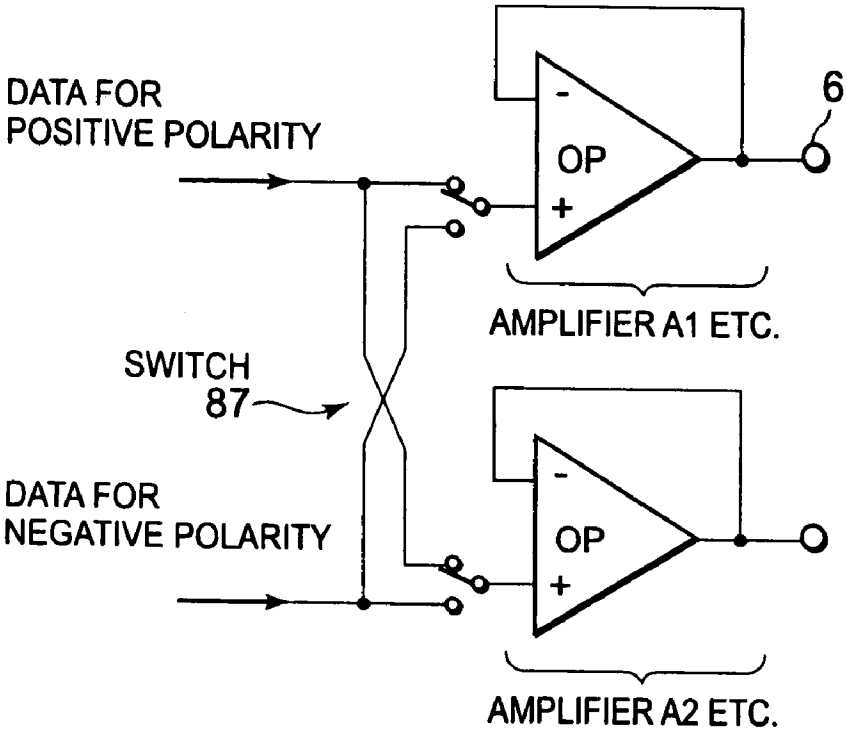
Figure 8:
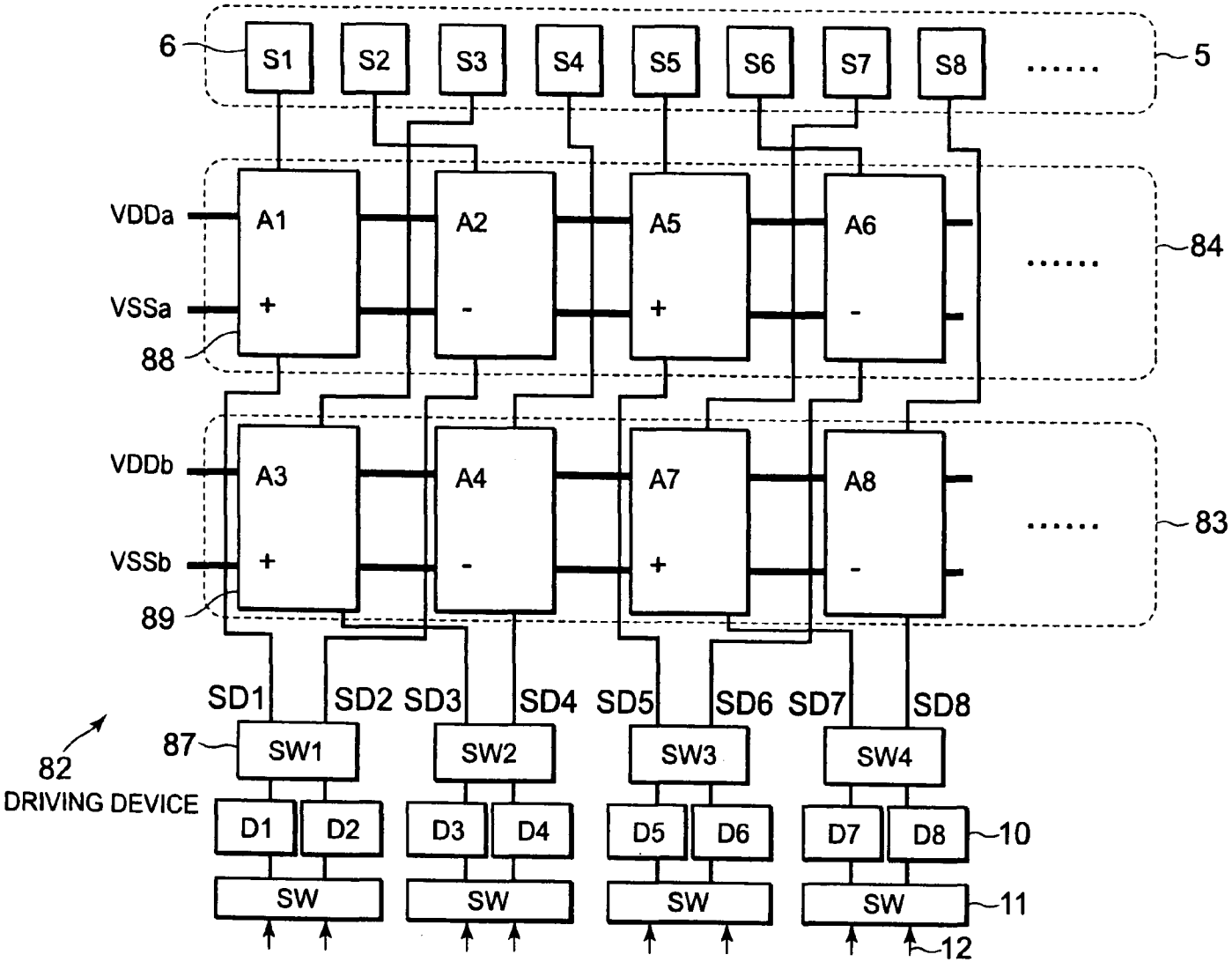
FIG. 8 is a block diagram of a driving device of the rail-to-rail amplifier type according to the fourth embodiment.

FIG. 7 is a schematic diagram showing the configuration of a driving device 82 of a fourth embodiment in comparison with the driving device of P/N buffer amplifier type as described earlier. FIG. 7A shows the case of the amplifier of the P/N buffer amplifier type. On the other hand, FIG. 7B shows the configuration referred to as so-called a rail-to-rail type to be adopted in the fourth embodiment, wherein one amplifier can output signals of both positive polarity and negative polarity. To be specific, the configuration of the amplifier is such that an input signal is received at a positive input end of a differential amplifier OP, and an output end is connected to a negative input end to form so-called negative feedback aspect, so that output signals of both positive and negative polarities can be generated. Thus, the amplifier can output voltage signals of both polarities, and there is no need to change signals to be sent to the output terminals by switch at the back step of the amplifier. Accordingly, polarities can be switched by a switch 87 located at the front step of the amplifiers A1, A2, etc. This can eliminate the effect of impedance of the switch 7 when the switch 7 is located at the back step of the amplifier, thereby enabling the level of output signals to be more intense and of higher accuracy. Thus, the output terminals S1, S2, etc. and the amplifiers A1, A2, etc. are connected in one-to-one correspondence. Each output terminal of the switch 87 is denoted SD1 to SD8 individually, as shown in FIG. 8. The switch output terminal SD1, etc. corresponds the amplifier A1, etc. in one-to-one relationship. Into the terminal of the switch outputs SD1 and SD2, the output from the signal processing circuits D1 and D2 which are changed or not change, as appropriate, are outputted. The switch outputs SD3 to SD8 are similar.

FIG. 8 is a schematic diagram showing the configuration of the driving device 82 in the fourth embodiment. Same reference numerals are assigned to the configuration similar to the first to third embodiments and description thereof is omitted. After being changed as appropriated at the switch 87, the output from the signal processing circuit 10 is outputted from its output terminal SD1 to SD8, inputted to the amplifier A1 to A8, and outputted from the output terminal S1 to S8.

A connection relationship of the output terminal SD1, etc. of the switch, the amplifier A1, etc., and the output terminal S1 of the driving device is as follows, wherein those with the same numerals correspond to each other and are connected.

A connection relationship of the output terminals and the amplifiers in the fourth embodiment:

| Output Terminal of Switch | SD1 | SD2 | SD3 | SD4 | SD5 | SD6 | SD7 | SD8 |
|---|---|---|---|---|---|---|---|---|
| Amplifiers | A1 | A2 | A3 | A4 | A5 | A6 | A7 | A8 |
| Output Terminals of Driving Device | S1 | S2 | S3 | S4 | S5 | S6 | S7 | S8 |

In the driving device 82 of FIG. 8, amplifiers are divided and arranged in two arrays, constituting the arrays 83 and 84. In other words, the amplifiers A1, A2, A5, and A6 are adjacently arranged to each other in this order and constitute the array 84, while the amplifiers A3, A4, A7, and A8 are adjacently arranged to each other in this order and constitute the array 83. The amplifiers belonging to the array 83 are also referred to as the amplifiers 89, and those of the array 84 are referred to as the amplifiers 88. The arrays 83 and 84 of the amplifiers are adjacent to each other and also arranged adjacent to the array 5 of output terminals. The amplifiers 88 belonging to the array 84 may be adjacent to the respective amplifiers 89 belonging to the array 83 in a direction orthogonal to a direction in which the array 5 extends, i.e., right and left directions of the figure. FIG. 8 shows such the case, in which the amplifiers A1 and A3, for example, are arranged in the vertical direction of the figure. However, for the sake of convenience of the layout, a positional relationship between the amplifiers 88 and 89 can be adjusted to be slightly shifted from each other in the right and left direction as appropriate. Here, the essential point is that the amplifiers 88 and 89 should be arranged side by side in a predetermined direction that is not parallel to the direction of the array 5. In FIG. 8 the amplifiers A1, A2, A5, and A6 are arranged with the amplifiers A3, A4, A7, and A8, respectively, in this predetermined direction.

One pair of power source wires VDDb and VSSb as already mentioned and another pair of the power source wires VDDa and VSSa are provided for such the arrays of amplifiers 83, 84, respectively. The amplifiers 89 belonging to the array 83 are commonly connected to the pair of the power source wires VDDb and VSSb and thus commonly receive supply of power. In contrast, the amplifiers 88 belonging to the array 84 are commonly connected to the pair of the power source wires VDDa and VSSa, and commonly receive supply of power. Although both the power source wires VDDa and VDDb are wires for supplying the source supply VDD, they are independently provided, corresponding to the arrays 84 and 83, respectively, and is not interconnected between the arrays, and extend in parallel to the arrays 83, 84, 5. Similarly, although both the power source wires VSSa and VSSb are wires for supplying the ground voltage VSS, each of them is independently provided, corresponding to the arrays 84 and 83, and is not interconnected between the arrays, and each extends in parallel to the arrays 83, 84, 5.

Figure 9B:
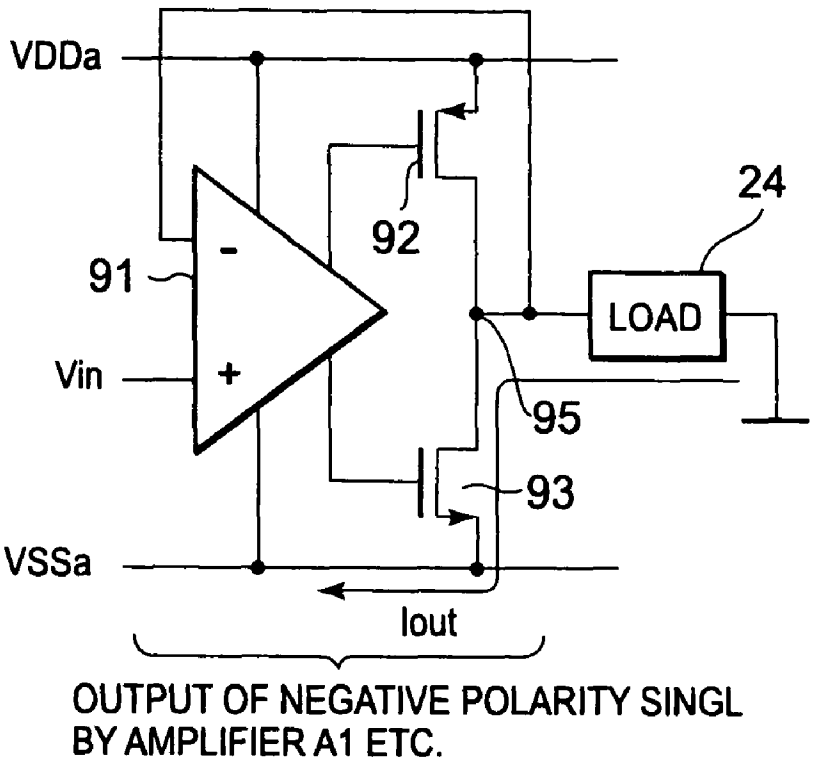
FIGS. 9A and 9B are a circuit diagram of the rail-to-rail amplifier and a schematic view of a current path.
Figure 9A:
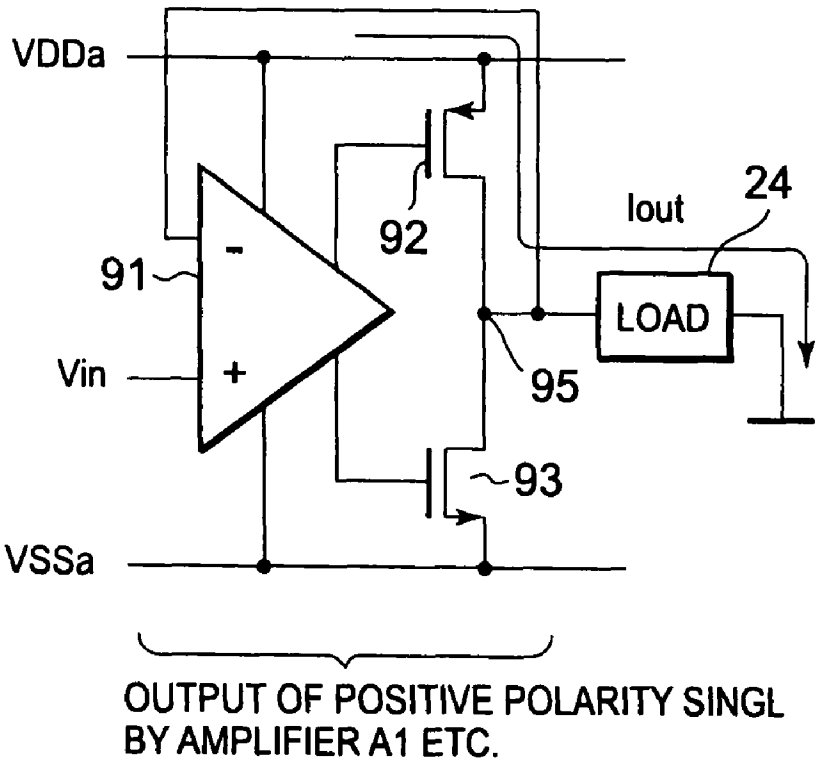

FIG. 9 is a schematic circuit diagram showing the configuration of an amplifier 88 belonging to the array 84, out of the rail-to-rail type amplifiers. FIG. 9A shows the case in which a positive polarity signal is outputted, and FIG. 9B shows the case in which a negative polarity signal is outputted. This also applies to an amplifier 89 belonging to the array 83 if the power source wire of FIG. 9 is replaced by VDDb and VSSb.

In FIG. 9A and FIG. 9B, an input signal Vin is a signal to be received via a switch 87 from the signal processing circuit 10, which is then supplied to a positive input terminal of a differential amplifier step 91. Outputs of the differential amplifier step 91 are connected to gate polarities of P-type transistor 92 and N-type transistor 93. The transistors 92 and 93 are connected in series between the pair of the power source wires VDDa and VSSa, and used as output transistors. A common connection node 93 of the transistors 92 and 93 is an output end of this amplifier 88. The output end 95 is connected to a negative input terminal of the differential amplifier step 91 and constitutes a feedback circuit. The differential amplifier step 91 drives within gate source supply voltage of the P-type transistor 92 and N-type transistor 93 at a voltage level reflecting a value of the input signal Vin. Consequently, the output voltage is appropriately generated within the voltage range of the ground potential VSS to the power source potential VDD to the output end 95.

Next, an operation of the driving device 82 will be described hereinafter. As described in FIG. 3, a configuration in which polarity of an output signal of the drive circuit 82 is reversed for every output terminal, mutually, among the output terminals S1, etc.

First, as already described, polarity of a signal that each of the signal processing circuits 10 can process is defined, wherein signal processing circuits D1, D3, etc. process and output positive polarity signals, while D2, D4, etc. process and output negative polarity signals. When a polarity inversion signal POL takes a logical value H, the switch 87 switches. Here all of the switches 87 enter the change connection aspect in which switches 87 accordingly, interchanges the right and left positions of the input signals, and outputs them. In this case, if positive polarity is signified by + symbol, and negative polarity is signified by – symbol, polarities of the output of the signal processing circuit D1, etc., polarities of output SD1 of the switch, polarities of the amplifier A1, etc. and polarities of the output terminal S1, etc. of the driving device is as follows:

Polarities of each of the signals when the polarity inversion signal is H:

| | | | | | | | | |
|---|---|---|---|---|---|---|---|---|
| Polarities of Signal Processing Circuit (Fixed) | D1 + | D2 – | D3 + | D4 – | D5 + | D6 – | D7 + | D8 – |
| Output polarities of Switch 87 | SD1 – | SD2 + | SD3 – | SD4 + | SD5 – | SD6 + | SD7 – | SD8 + |
| Polarities of amplifier | A1 – | A2 + | A3 – | A4 + | A5 – | A6 + | A7 – | A8 + |
| Polarities of output terminals | S1 – | S2 + | S3 – | S4 + | S5 – | S6 + | S7 – | S8 + |

In other words, the polarities of the output terminal S1, etc. are in the polarity inversion aspect as shown in FIG. 3.

Then, when the polarity inversion signal POL changes its logical value to L, the switch 87 switches to the normal order connection aspect. With this, a relationship of polarities of each of the signals is as follows:

Polarities of each of the signals when the polarity inversion signal is L:

| | | | | | | | | |
|---|---|---|---|---|---|---|---|---|
| Polarities of signal processing circuit (Fixed) | D1 + | D2 – | D3 + | D4 – | D5 + | D6 – | D7 + | D8 – |
| Output polarities of switch 87 | SD1 + | SD2 – | SD3 + | SD4 – | SD5 + | SD6 – | SD7 + | SD8 – |
| Polarities of amplifier | A1 + | A2 – | A3 + | A4 – | A5 + | A6 – | A7 + | A8 – |
| Polarities of output terminals | S1 + | S2 – | S3 + | S4 – | S5 + | S6 – | S7 + | S8 – |

FIG. 8 also shows the polarities of the amplifiers in this case with the similar + and – symbols.

As such, if the polarity inversion signal POL changes from H to L, in this new operation cycle, the amplifier A1, for example, has to drive, to a predetermined potential within the voltage range of positive polarity, the output terminal S1 that was driven to the potential of negative polarity in the previous operation cycle by the amplifier A1 and its accompanying signal line 1 and the load 24. This generates a large current output Iout. In other words, as shown in FIG. 9A, the amplifier A1 takes in a relatively large current from the power source wire VDDa and output it to the output terminal S1. Here, in the output amplifier A1, either there is no current flowing from the output terminal S1 to the power source wire VSSa of the ground potential, or there is only some transient current or some penetration current at steady time.

Similarly, each of the amplifiers A3, A5 and A7 that outputs a positive polarity signal takes in a relatively large current from the power source potential VDD and output it to the respective output terminals S3, S5 and S7 in this operation cycle. Thus, the sum of all currents which the positive polarity amplifiers are to flow from the potential VDD is very large if they were simply added. As described above, in the drive circuit 82, however, the amplifiers are divided into two predetermined groups so that the pairs of the power source wires connected thereto differ. The power source wire VDDa, for example, is commonly connected to some of the amplifiers that perform the positive polarity outputs in this operation cycle, i.e., A1 and A5, etc. and is independent of others, e.g., A3 and A7, etc. Thus, even when the positive polarity amplifiers A1 and A5, etc. operate simultaneously in this cycle, current to run through the power source wire VDDa can be kept low, thereby enabling stable maintenance of the potential VDD of the power source wire VDDa. Hence, outputs of the amplifiers A1 and A5, etc., do not oscillate due to fluctuations in the power source potential.

Similarly, other power source wire VDDb is also commonly connected to some of the amplifiers that become positive polarity in this operation cycle, i.e., A3 and A7, etc. and is independent of others, i.e., A1 and A5, etc. Thus, even when the positive polarity amplifiers A3 and A7, etc. operate simultaneously, current to run through the power source wire VDDb can be kept low, thereby enabling stable maintenance of the potential VDD of the power source wire VDDb. Hence, outputs from the amplifiers A3 and A7, etc., do not oscillate due to fluctuations in the power source potential.

In addition, in this operation cycle, the amplifier A2 has to drive, to a predetermined potential in a range of negative polarity, the output terminal S2 that was driven to the potential of positive polarity in the last operation cycle by the amplifier A2 and its accompanying signal 1 and the load 24. This generates a large negative current output Iout. In other words, in this case, the amplifier A2 takes in current from the signal line 1 and flow it to the ground power supply wire. FIG. 9B shows this condition. To drive the signal line 1 and its load 24 with a negative polarity output signal, the amplifier A2 takes in a relatively large current from the output terminal S2, and discharge it to the power source wire VSSa of ground potential. In addition, in the output amplifier A2, there is no current flowing from the power source wire VDDa to the output terminal S2, or there is only some transient current or some penetration current at steady time.

Similarly, each of the amplifiers A4, A6 and A8 that becomes negative polarity in this operation cycle takes in a relatively large current from the signal line 1, and discharge it to the each of the power source wires of the ground potential. Thus, the sum of all currents which the negative polarity amplifiers are to flow to the ground potential would be large if they were simply added. As described above, in the drive circuit 82, however, the amplifiers are divided into two predetermined groups so that the pairs of the power source wires connected thereto differ. The power source wire VSSa of the ground potential, for example, is commonly connected to some of the amplifiers that simultaneously become negative polarity, i.e., A2 and A6, etc. and is independent of others, e.g., A4 and A8, etc. Thus, even when the negative polarity amplifiers A2 and A6, etc. operate simultaneously, current to run through the power source wire VSSa can be kept low, thereby enabling stable maintenance of the ground potential VSS of the power source wire VSSa. Hence, outputs of the amplifiers A2 and A6, etc., do not oscillate due to fluctuations in the power source potential.

Similarly, other power source wire VSSb can also keep the current low, thereby enabling stable maintenance of the potential VSS of the power source wire VSSb. Thus, outputs of the corresponding amplifiers A4 and A8 do not oscillate due to fluctuations in the power source potential.

In this embodiment, to the power source wire VDDa, the amplifiers A1 and A5 that are part of the amplifiers that flow a large current from the power source potential VDD and that perform positive polarity operations in the same operation cycle are commonly connected, and also the amplifiers A2 and A6 that flow little current from the power source potential VDD and that perform negative polarity operation in that operation cycle are also commonly connected. This also applies to other power source wires VDDb, VSSa, and VSSb. In essence, the driving circuit is configured of two groups of amplifiers associated with separate power source wires, each of the two groups includes both of amplifiers simultaneously performing operations of one of the polarities and amplifiers not performing operations of the one polarity simultaneously with the former amplifiers, and the amplifiers of each of the two groups are commonly connected to one of the separate power source wires. As for the arrangement of amplifiers, the amplifiers simultaneously performing operations of the same polarity are divided to belong to two different arrays, and the amplifiers that do not perform operations of the same polarity simultaneously are adjacently arranged in each of the arrays. With this configuration, in this embodiment, the amplifiers that do not operate simultaneously are commonly connected to each of the power source wires, and the two power source wires are used at the different timings. Meanwhile the amplifiers simultaneously performing are associated with the different power source wires. This also produces the effect of preventing power source fluctuations without needing an increase of the number of power source wires. In addition, according to the device of this embodiment, the amplifiers that operate under the same power source potential and the same ground potential are employed as both of the amplifiers of positive polarity and negative polarity. This prevents fluctuations in the output characteristics, which might be caused due to use of different amplifiers that operate under different power sources for positive and negative polarities.

The similar effect can also be achieved in the operation of when the polarity inversion signal POL changes to H again.

In the above description, although the configuration corresponding to the output terminals S1 to S8 was described, more output terminals and their amplifiers Ai (i is a natural number) and switch 87 may be provided in the aspect of repeating the configuration as above described. In that case, the arrays of amplifiers 84 and 83 each have a large number of amplifiers, and the power source wires VDDa, VSSa, VDDb and VSSb are also connected to a large number of amplifiers. However, as configuration as in this embodiment can halve the number of amplifiers to be connected to the pair of the power source wires when compared with the conventional configuration, thus reliably enabling prevention of fluctuations in the power source voltage and stable output signals.

Fifth Embodiment

The driving device 82 shown in FIG. 8 can be applied to the method of driving in FIG. 4 by making some modifications to the operation of the switch 87 while keeping the connection aspect of the output terminal and the amplifiers as they are. When the polarity inversion signal POL is H, for example, first, the polarities of an output signal S1, etc. and the amplifier A1, etc. shall be as follows:

Polarities of the output terminals and the amplifiers when the polarity inversion signal is H

| Amplifiers | A1 | A2 | A3 | A4 | A5 | A6 | A7 | A8 |
|---|---|---|---|---|---|---|---|---|
| | − | + | + | − | − | + | + | − |
| Output Terminals (S8) | S1 | S2 | S3 | S4 | S5 | S6 | S7 | S8 |
| | − | + | + | − | − | + | + | − |

In other words, polarities of the amplifiers A1, A2, A5, and A6 belonging to the array 84 of the amplifiers are in the order of −+−+, while polarities of the amplifiers A3, A4, A7, and A8 are in the order of −+−+. Thus, any of the arrays is such configured to have some amplifiers that simultaneously perform operations of same polarity, which can prevent currents from being concentrated, thus enabling prevention of fluctuations in power source supply and maintenance of stable output signal. In addition, in both of arrays, amplifiers are arranged so that adjacent two amplifiers do not perform operations of same polarity simultaneously. Accordingly, it is possible to prevent concentration of currents without increasing the number of power source wires, thus enabling prevention of fluctuations in power source supply and maintenance of stable output signal. This also applies to the case the polarity inversion signal is L.

In case of applying the fifth embodiment, the device is configured as followed: In the following, each of switches 87 is referred to as SW1, SW2, etc., as shown in FIG. 8. First, when the polarity inversion signal POL is H, in the fourth embodiment, all of the switches 87 were in the interchanged connection aspect. However, this is changed in the fifth embodiment so that the switch SW1 and SW3 are in the interchanged connection aspect, and SW2 and SW4 are in normal order connection aspect. On the other hand, when the polarity inversion signal POL is L, the switch SW1 and SW3 are switched to normal order connection aspect and SW2 and SW4 to interchanged connection aspect.

In the same driving device 82 as the fourth embodiment, the fifth embodiment can be implemented by switching, by an internal mode signal, the signals supplied to switches SW2 and SW4 to a polarity inversion signal POL or its inversed signal/POL.

Sixth Embodiment

In the fifth embodiment, the configuration is such that each of the power source wires of the power source potential VDD and those of the ground potential VSS are provided by two kinds. However, similar to FIG. 6, for the power source wire of the ground potential VSS, a wire VSSc common to the arrays 83 and 84 may be formed, while, for the power source wire of the power source potential VDD, the power source wires VDDa and VDDb are formed using the above configuration. The configuration in this manner enables a power source wire VSSc to be formed thicker by providing some extra area between the arrays of the amplifiers 83 and 84. Thus, even when the amplifiers belonging to the array 83 and the array 84 perform negative polarity signal output operations simultaneously, fluctuation in the potential can be prevented. Meanwhile, as similar to the fourth and fifth embodiments, the power source wires VDDa and VDDb correspond to the array 84 and array 85, respectively, and independently supply the power source potential to each array. Accordingly, fluctuations in the power source potential can be prevented by limiting the volume of current and thus preventing fluctuations in the output signals. In other words, even in a case where there is no extra area for the power source wire VSSc and resistance cannot be lowered by thickening a wire, the potential fluctuations in the power source wires VDDa and VDDb can be prevented, thereby enabling maintenance of stable output signal. Similarly, a configuration may be possible in which the power source wire VDDC is made common, and the power source wires of the ground potential VSSa and VSSb are provided separately.

Seventh Embodiment

Figure 10:
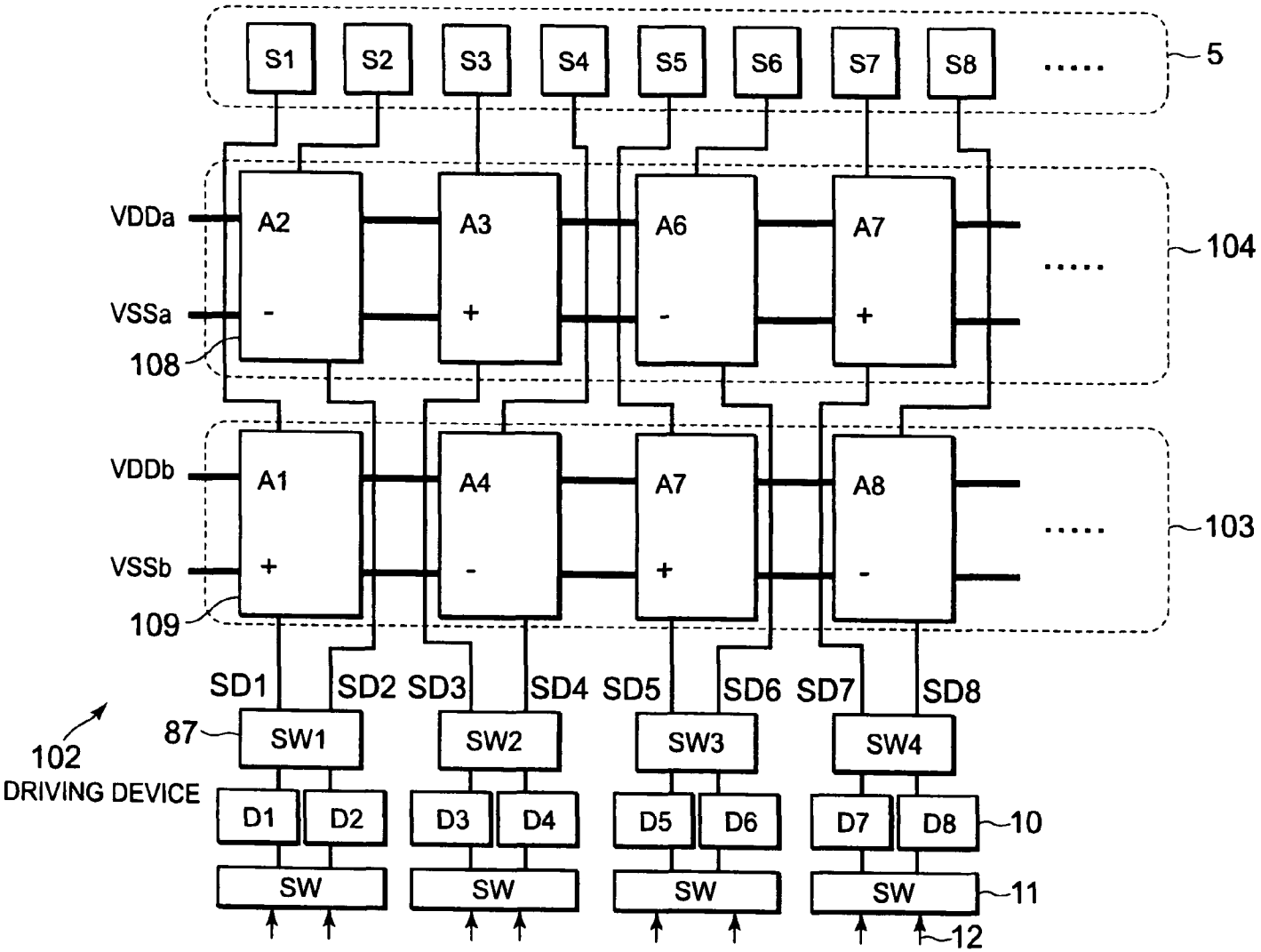
FIG. 10 is a block diagram of a driving device of the rail-to-rail amplifier type according to the seventh embodiment.

FIG. 10 is a schematic diagram showing a driving device of a seventh embodiment. Same reference numerals are assigned to any component that is same as FIG. 8, and the description thereof is omitted.

In the driving device 102 in FIG. 10, amplifiers are separately arranged in two arrays, constituting arrays 103 and 104. In fact, the amplifiers A2, A3, A6, and A7 are arranged in this order adjacent to each other and constitute the array 104, while the amplifiers A1, A4, A5, and A8 are arranged in this order adjacent to each other and constitute the array 103. The amplifiers belonging to the array 103 are referred to the amplifier 109, and those of the array 104 are referred to as the amplifier 108. The arrays of the amplifiers 103 and 104 are adjacent to each other, and also adjacently arranged to an array 5 of output terminals. Each amplifier 108 belonging to the arrangement 104 and each amplifier 109 belonging to the array 103 may be adjacent to each other in a direction orthogonal to a direction in which the array 5 extends, i.e., the right and left directions on the figure. FIG. 10 shows such the case. The amplifiers A1 and A2, for example, are arranged in the vertical direction of the figure. However, for the sake of convenience of the layout, a positional relationship between the amplifiers 108 and 109 can be adjusted so that they are slightly misaligned in the right and left direction, as appropriate. Here, the amplifiers 108 and 109 may be arranged side by side in a predetermined direction not parallel to the direction of the array 5. In FIG. 8, the amplifiers A2, A3, A6, and A7 are arranged with the amplifiers A1, A4, A5, and A8, respectively, in the predetermined direction.

For the array 103 of the amplifiers, one pair of the power source wire VDDb and Vssb are provided as mentioned above, and for the array 104 another pair of the power supply wires VDDa and VSSa are provided. The amplifiers 109 belonging the array 103 are commonly connected to the pair of the power source wires VDDb and VSSb, and commonly receive supply of power. Meanwhile, the amplifiers 108 belonging to the array 104 are commonly connected to the pair of the power source wires VDDa and VSSa and commonly receive supply of power. Although both of the power source wires VDDa and VDDb are wires for supplying the power source voltage VDD, they are independently provided corresponding to the arrays 104 and 104, and are not interconnected between the arrays, and each of them extend in parallel to the arrangement 103, 104, and 5. Similarly, although, both of the power source wires VSSa and VSSb are wires for supplying the ground voltage VSS, they are independently provided corresponding to the arrays 104 and 103, and are not interconnected between the arrays, and each of them extend in parallel to the arrangement 103, 104, and 5

Next, an operation of the driving device 102 will be described hereinafter. First, as described in FIG. 3, the configuration in which polarity of an output signal of the driving circuit 102 is from one after the other, mutually among the output terminals S1, etc. is described.

When the polarity inversion signal POL takes a logical value H, the switches 87 switch accordingly, and all of the switches 87 enter the interchanged connection aspect in which the right and left positions of input signals are interchanged and then outputted. In this case, if positive polarity is expressed by + symbol and negative polarity by − symbol, polarities of the switch output SD1, etc., polarities of the amplifier A1, etc., and polarities of the output terminal S1, etc. of the driving device, will be as follows:

Polarities of Each of Signals when the Polarity Inversion Signal is H:

| | | | | | | | | |
|---|---|---|---|---|---|---|---|---|
| Output polarity of switches 87 | SD1 − | SD2 + | SD3 − | SD4 + | SD5 − | SD6 + | SD7 − | SD8 + |
| Polarities of amplifiers | A1 − | A2 + | A3 − | A4 + | A5 − | A6 + | A7 − | A8 + |
| Polarities of output terminals | S1 − | S2 + | S3 − | S4 + | S5 − | S6 + | S7 − | S8 + |

Then, when the polarity inversion signal POL changes the logical value to L, and the switches 87 switch to the normal order connection aspect, a relationship of polarities of each of signals shall be as follows:

Polarities of Each of Signals when the Polarity Inversion Signal is L:

| | | | | | | | | |
|---|---|---|---|---|---|---|---|---|
| Output polarity of switch 87 | SD1 + | SD2 − | SD3 + | SD4 − | SD5 + | SD6 − | SD7 + | SD8 − |
| Polarities of amplifiers | A1 + | A2 − | A3 + | A4 − | A5 + | A6 − | A7 + | A8 − |
| Polarities of output terminals | S1 + | S2 − | S3 + | S4 − | S5 + | S6 − | S7 + | S8 − |

FIG. 10 also shows the polarities of the amplifiers in this case, similarly by + and − symbols.

As described above, when the polarity inversion signal POL changes from H to L, in a new operation cycle, each amplifier have to drive an output terminal with polarity opposite to the polarity with which the amplifier drove the output terminal in the last cycle. Thus, the amplifier that performs positive polarity output in this operation cycle takes in more current from the power source potential VDD and flow it to the output terminal, however flows almost no current to the ground potential. In contrast, the amplifier that performs negative polarity output in this operation cycle absorbs current from the output terminal and flow much current to the ground potential VSS. In contrast, it takes in little current from the power source potential VDD.

Thus, if the current to be flown from the potential VDD by all the positive polarity amplifiers are simply added up, the sum would be very large. As described above, in the drive circuit 102, however, the amplifiers are divided into two predetermined groups so that the pairs of the power source wires connected thereto differ, and the power source wires VDDa are commonly connected to some of the amplifiers that perform positive polarity output in this operation cycle, namely A3 and A7, etc., and independent from other positive polarity amplifiers, such as A1 and A5, etc. Thus, even when the positive polarity amplifiers A3 and A7, etc. simultaneously operate in this cycle, current to run through the power source wire VDDa can be kept low, thereby enabling maintenance of stability in the potential VDD of the power source wire VDDa. Thus, outputs of the amplifiers A3 and A7, etc. do not oscillate, due to fluctuations in the power source voltage.

Similarly, in the array 103, the potential in the power source wire VDDb does not oscillate, thus enabling output potential of the amplifiers A1 and A5 to be prevented from becoming unstable. In addition, similarly, in both the arrays 103 and 104, fluctuations in the potential of the power source wire VSSa and VSSb of the ground potential can be prevented, and outputs of the negative polarity amplifiers A2, A4, A6 and A8 can be stabilized in this cycle.

In addition, when considering the power source wire VDDa, not only the amplifiers A3 and A7 that are part of the positive polarity amplifiers are connected, but also the amplifiers A2 and A6 that are the negative polarity amplifiers in this operation cycle are commonly connected. Configured in such a manner, the amplifiers A2 and A6 at this time flow little current from the power source wire VDDa. Thus, there is no possibility that fluctuations in the power source potential occur, and since the amplifiers A2, A3, A6, and A7 share the power source wires, the power supply and the output signals can be stabilized without increasing the number of the power source wires and expanding the circuit scale. This also applies to the embodiment of FIG. 8. In addition, this also applies to actions when the polarity inversion signal POL changes to H again.

Eighth Embodiment

A driving device 102 as shown in FIG. 10 can be used for the inversion driving in which output terminal S1 interchanges polarity for every two terminals, or for H2 dot inversion drive system described before, by changing the configuration of the switches 87 while the connection aspect between the output terminals and the amplifiers set are kept as in FIG. 10. In this case, however, the driving method of FIG. 5 is used. Compared with that in FIG. 4, in the driving method of FIG. 5, the relation of the polarities is such that regularity of polarities is shifted by 1 output terminal. In other words, in this method, the output terminals S1 and S2 have same polarity, the output terminal S3 or S4 have the same polarity to each other and are opposite to the output terminals S1 and S2, etc., and the polarity changes for every two output terminals subsequently. In this case, when the polarity inversion signal POL is H, for example, the polarities of the output signal S1 and the amplifier A1, etc. is as follows:

Polarities of the Output Terminal and the Amplifier when the Polarity Inversion Signal is H

| | | | | | | | | |
|---|---|---|---|---|---|---|---|---|
| Amplifiers | A1 | A2 | A3 | A4 | A5 | A6 | A7 | A8 |
| | + | + | − | − | + | + | − | − |
| Output Terminal | S1 | S2 | S3 | S4 | S5 | S6 | S7 | S8 |
| | + | + | − | − | + | + | − | − |

In other words, polarities of the amplifiers A2, A3, A6, and A7 belonging to the array 104 of the amplifiers are +−+− in this order, and polarities of the amplifiers A1, A4, A5, and A8 of the array 103 is +−+− in this order. Thus, both arrays are configured so that it contains part of the amplifiers that simultaneously perform operations of same polarity. Accordingly concentration of currents is prevented, thereby preventing fluctuations in power source potential and maintaining stable output signals. In addition, in both of the arrays, the amplifiers that do not perform operations of same polarity simultaneously are adjacently arranged, so that concentration of currents can be prevented without increasing the number of power supply wires, thereby enabling prevention of fluctuations in the power supply potential and stable output signals. This also applies to when the polarity inversion signal is L.

In a case of applying the eighth embodiment, the device is configured as followed: First, as the output terminals S1 and S2 have same polarity, they correspond to the signal processing circuits D1 and D3 in the case of positive polarity, and correspond to the signal processing circuits D2 and D4 in the case of negative polarity. In addition, as the output terminals S3 and S4 have polarity opposite thereto, and have same polarity to each other, in the case of negative polarity, they correspond to the signal processing circuits D2 and D4, and correspond to the signal processing circuits D1 and D3 in the case of positive polarity. In other words, switches 870 (not shown) is newly provided instead of the switches 87, and one of the switches 870 is configured so that, in response to H or L of the polarity inversion signal POL value, it connects outputs of the signal processing circuits D1 and D2 to the amplifiers A1 and A3 in this order, or in the reversed order. In addition, another the switches 870 is configured so that, in response to H or L of the polarity inversion signal POL value, it connects outputs of the signal processing circuits D3 and D4 to the amplifiers A2 and A4 in this order, or in the reversed order. In addition, yet another switch 870 is configure so that it connects the signal processing circuits D5 and D6 to the amplifiers A5 and A7 by the similar aspect. Still another switch 870 is configured so that it connects the signal processing circuits D7 and D8 to the amplifiers A6 and A8 by the similar aspect.

Ninth Embodiment

Similarly to the third embodiment and sixth embodiment, in the driving device 102 of FIG. 10, the configuration may be such that the power source wire VDDc is commonly provided for the arrays 103 and 104, and the power source wires VSSa and VSSb of the ground potential are provided separately and independently. In addition, the configuration may be such that the power source wire Vssc of the ground potential is commonly provided in both arrays and the power source wires VDDa and VDDb are separately provided, by contrast. In both cases, similar to the third embodiment or the sixth embodiment, stability of the power supply potential and stability of output signals can be achieved.

Tenth Embodiment

Figure 11:
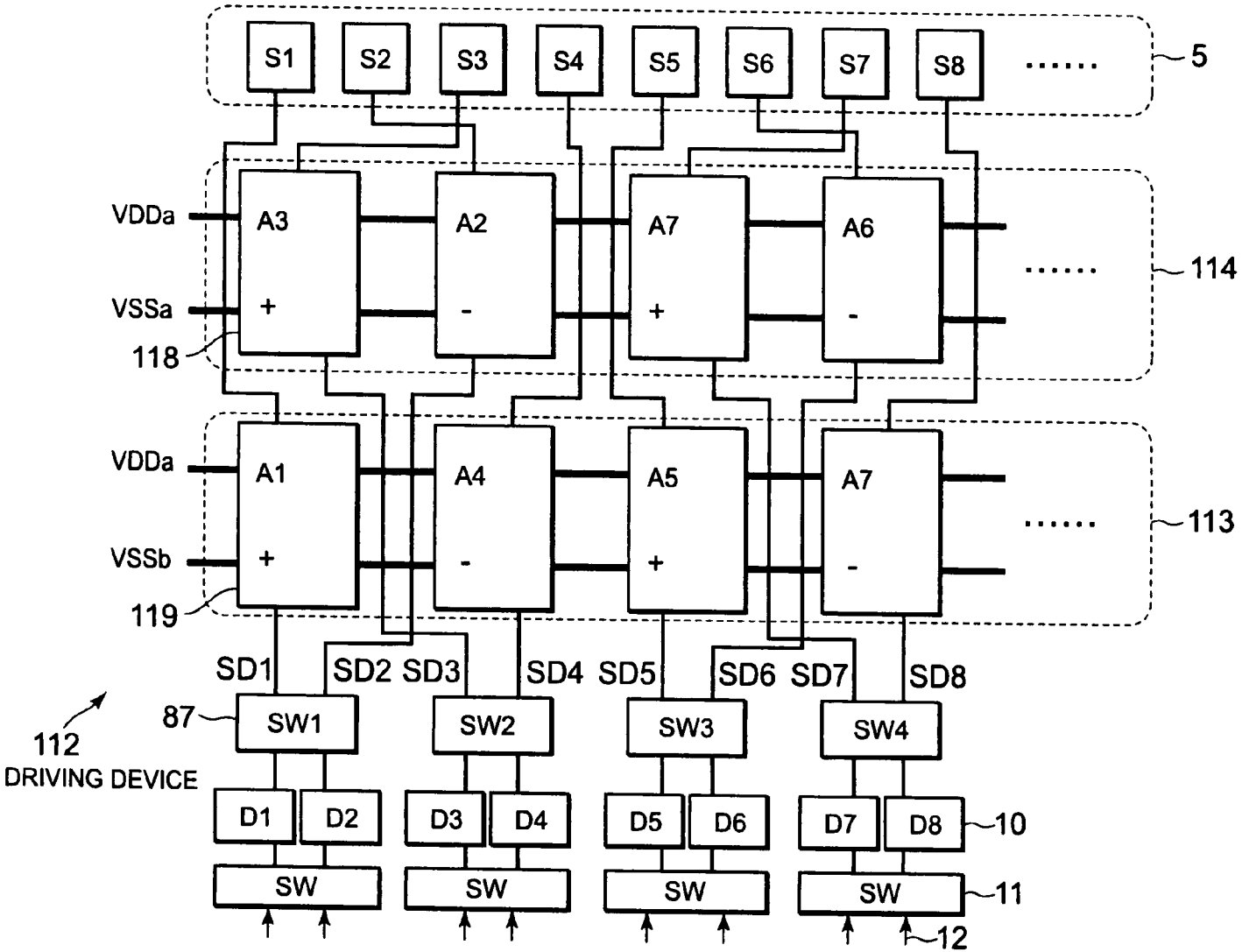
FIG. 11 is a block diagram of a driving device of the rail-to-rail amplifier type according to the tenth embodiment.

FIG. 11 shows a driving device 112 in a tenth embodiment. It differs from the driving device of FIG. 10 in following point. The amplifiers A1 to A8 corresponding to the output terminal S1 to S8 in this order are divided into two groups, and the amplifiers A3, A2, A7, and A6 are adjacently formed in this order to constitute an array 14, while the amplifiers A1, A4, A5, and A8 are adjacently formed in this order to constitute an array 113. Here, the array 114 is arranged adjacent to the array 5, and the array 114 is arranged adjacent to the array 114. The amplifiers A3, A2, A7, and A6, and the amplifiers. A1, A4, A5, and A8 are arranged adjacent to each other in this order, in a predetermined direction that is not parallel to the array 5 of the output terminals. The determined direction may be orthogonal to the array 5 or slanted, depending on convenience of the layout. In a case where the inversion driving of FIG. 3 is performed with this configuration, when the polarity inversion signal is H, polarities of the amplifiers A3, A2, A7, and A6 of the array 114 are −+−+ in this order, and polarities of the amplifiers A1, A4, A5 and A8 of the array 113 are −+−+ in this order. When the polarity inversion signal POL is L, each polarity of the amplifiers is reversed. Consequently, as described above, both arrays contain a part of the amplifiers that have same polarity, and thus can prevent concentration of currents to the power source wire, stabilize the power source potential, and ensure stability of output signals. In addition, the amplifiers arranged and connected commonly so that the adjacent amplifiers do not become same polarity simultaneously, and the effect of stabilizing output can be achieved without expanding the device.

In a driving method in which every two output terminals are made to have different polarities, the driving method of FIG. 5 is conducted. In other words, when the polarity inversion signal is H, polarities of the amplifiers A3, A2, A7, and A6 of the array 114 are −+−+ in this order, and polarities of the amplifiers A1, A4, A5 and A8 of the array 113 are +−+− in this order. When the polarity inversion signal POL is L, each polarity of the amplifiers is reversed. Consequently, as described above, both arrays contain a part of the amplifiers that have same polarity, and thus can prevent concentration of currents to the power source wire, stabilize the power source potential, and ensure stability of output signals. In addition, the amplifiers arranged and connected commonly so that the adjacent amplifiers do not become same polarity simultaneously, and the effect of stabilizing output can be achieved without expanding the device.

Then, in the driving device 112 of FIG. 11, when the driving method of FIG. 5 is conducted, the same manner as the eighth embodiment is taken. In other words, since the output terminals S1 and S2 have same polarity, they correspond to the signal processing circuits D1 and D3 when it is positive polarity, and correspond to the signal processing circuits D2 and D4 when it is negative polarity. In addition, the output terminals S3 and S4 have polarity opposite to the output terminals S1 and S2, and have the same polarity to each other. Thus, they correspond to the signal processing circuits D2 and D4 when it is negative polarity and correspond to the signal processing circuits D1 and D3 when it is positive polarity. Here, instead of the switches 87, switches 870 (not shown) are provided similar to the eighth embodiment. One of the switches 870 is configured so that, in response to H or L of the polarity inversion signal POL value, it connects outputs of the signal processing circuits D1 and D2 to the amplifiers A1 and A3 in this order or reversed order. In addition, another switch 870 is configured so that in response to H or L of the polarity inversion signal POL value, it connects outputs of the signal processing circuits D3 and D4 to the amplifiers A2 and A4 in this order, or in reversed order. In addition, yet another switch 870 is configured so that it connects the signal processing circuits D5 and D6 to the amplifiers A5 and A7 in the similar aspect, and still another switch 870 is configured such that it connects the signal processing circuits D7 and D8 to the amplifiers A6 and A8 by the similar aspect.

In addition, in the driving device 12 of FIG. 11, the configuration may be such that the power source wire VDDc is commonly provided in the arrays 113 and 114, and the power source wires VSSa and VSSb of the ground potential are provided separately and independently. Or in contrast, the configuration may be such that the power source wire Vssc of the ground potential is commonly provided in both arrays, and the power source wires VDDa and VDDb are provided separately. In both cases, similar to the third embodiment or the sixth embodiment, it is possible to stabilize the power source potential and to stabilize the output signals.

Eleventh Embodiment

Figure 12:
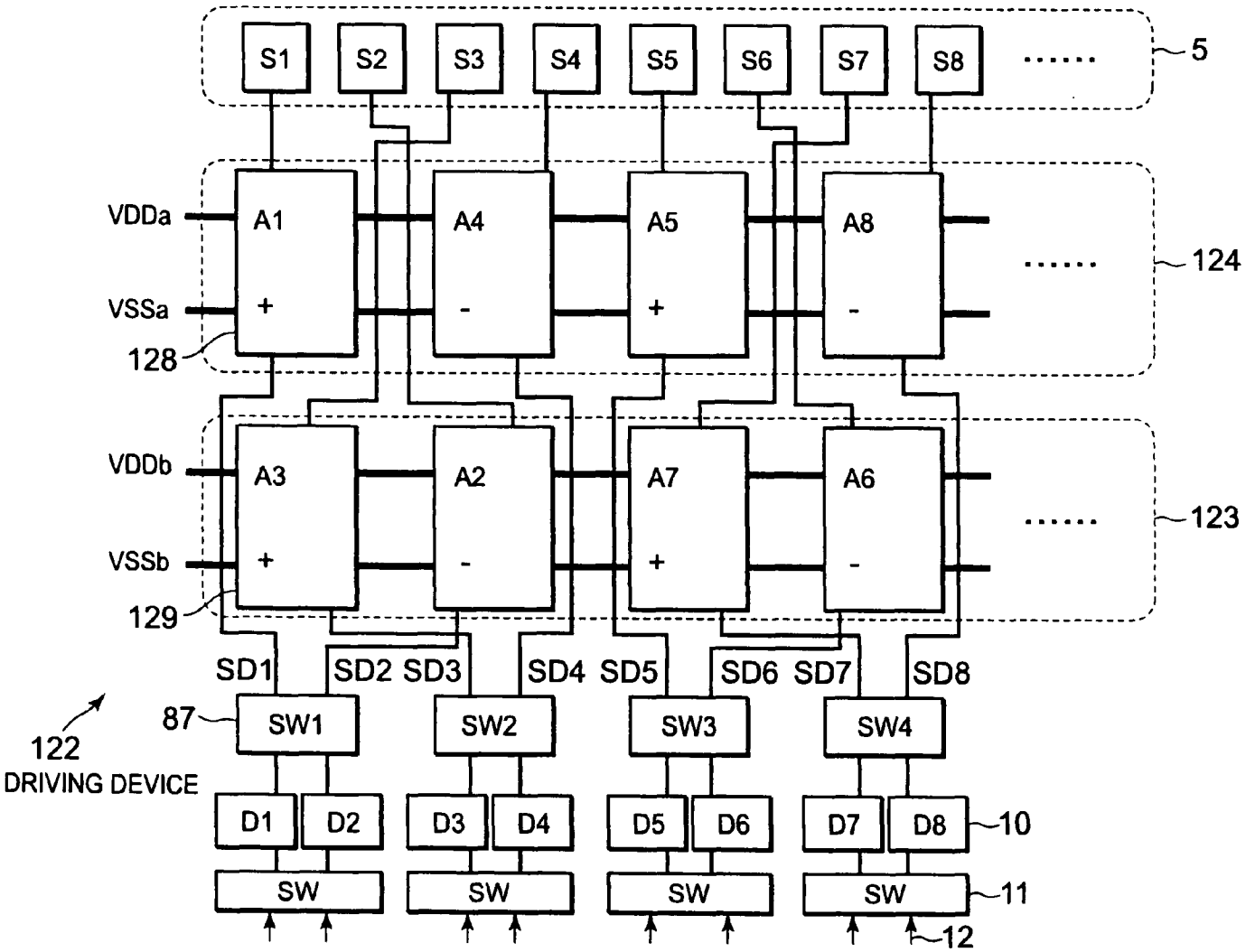
FIG. 12 is a block diagram of a driving device of the rail-to-rail amplifier type according to the eleventh embodiment.

FIG. 12 shows a driving device 122 in an eleventh embodiment. It differs from the driving device in FIG. 11 in that when the amplifiers A1 to A8 corresponding to the output terminals S1 to S8 in this order is divided into two groups, the amplifiers A1, A4, A5, and A8 are adjacently formed in this order to constitute an array 124, and arranged adjacent to the array 5 of the output terminals, and that the amplifiers A3, A2, A7, and A6 are adjacently formed in this order to constitute an array 123, and arranged adjacent to the array 124. The amplifiers A3, A2, A7, and A6, and the amplifiers A1, A4, A5, and A8 are arranged adjacent to each other in this order in a predetermined direction that is not parallel to the array 5 of the output terminals. Depending on convenience of the layout, the predetermined direction may be orthogonal to the array 5 or slanted rather than being orthogonal. With this configuration, in a case where the inversion driving in FIG. 3 is performed, when the polarity inversion signal POL is H, polarities of the amplifiers A1, A4, A5, and A8 in the array 124 are −+−+ in this order, and polarities of the amplifier A3, A2, A7, and A6 in the array 123 are −+−+ in this order. When the polarity inversion signal POL is L, each polarity of the amplifiers are reversed. Thus, both arrays contain a part of the amplifiers that become same polarity simultaneously, and thus, as described above, can prevent concentration of currents onto the power source wires, thereby stabilizing the power source potential and ensuring stability of output signals. In addition, the amplifiers that do not become same polarity simultaneously are contained and connected adjacent to each other, thus it is possible to achieve the effect of stabilizing output without expanding the device.

In addition, In a case of applying the driving method where polarities of the output terminals varies every two output terminals, the method of FIG. 5 can be used. In other words, when the polarity inversion signal POL is H, polarities of amplifiers A3, A2, A7 and A6 adjacent to each other are −+−+ in this order, and polarities of the amplifiers A1, A4, A5, and A8 are +−+− in this order. When the polarity inversion signal is L, the polarities of each amplifier are inversed polarities of these. Consequently, both arrays contain a part of the amplifiers that become same polarity simultaneously, and thus, as described above, can prevent concentration of currents onto the power source wires, thereby stabilizing the power source potential and ensuring stability of output signals. In addition, the amplifiers that do not become same polarity simultaneously are contained and connected adjacent to each other, thus it is possible to achieve the effect of stabilizing output without expanding the device.

Then, if the driving method of FIG. 5 is performed in the driving device 122 in FIG. 12, the same manner as the eighth embodiment is taken. In other words, since the output terminals S1 and S2 have same polarity, they correspond to the signal processing circuits D1 and D3 in the case of positive polarity, and correspond to the signal processing circuits D2 and D4 in the case of negative polarity. In addition, as the output terminals S3 and S4 have polarity opposite to the output terminals S1 and S2, and have same polarity to each other, in the case of negative polarity, they correspond to the signal processing circuits D2 and D4, and correspond to the signal processing circuits D1 and D3 in the case of positive polarity. In other words, a switch 870 (not shown) is newly provided instead of the switches 87, and one of the switches 870 is configured so that, in response to H or L of the polarity inversion signal POL value, it connects outputs of the signal processing circuits D1 and D2 to the amplifiers A1 and A3 in this order, or in the reversed order. In addition, another of the switches 870 is configured so that, in response to H or L values of the polarity inversion signal POL, it connects outputs of the signal processing circuits D3 and D4 to the amplifiers A2 and A4 in this order or in the reversed order. In addition, yet another switch 870 is configured so that it connects the signal processing circuits D5 and D6 to the amplifiers A5 and A7 by the similar aspect. Still another switch 870 is configured so that it connects the signal processing circuits D7 and D8 to the amplifiers A6 and A8 by the similar aspect.

In addition, similarly, it is also possible to have polarities differ for every 3 or more output terminals. For example, when polarities differ for every 3 output terminals, the output terminals S1, S2 and S3 correspond to the signal processing circuits D1, D3 and D5 in the positive polarity, and correspond to D2, D4 and D6 in the negative polarity. In addition, output terminal S4, S5, and S6 correspond to the signal processing circuits D2, D4 and D6 in the negative polarity, and correspond to D1, D3, and D5 in the case of positive polarity. In other words, new switches 8700 is provided, and one of the switches 8700 inputs the outputs of the signal processing circuit D1 and D2 to the output terminals S1 and S4 in normal order or in reversed order. Another switch 8700 may be configured so that outputs of the signal processing circuits D3 and D4 are outputted to the output terminals S2 and S5 in normal order or in reversed order. Another switch 8700 may be configured so that outputs of the signal processing circuits D5 and D6 are outputted to the output terminals S3 and S6 in normal order or in reversed order.

In addition, in the driving device 122 of FIG. 12, the configuration may be such that the power source wire VDDc is commonly provided in the arrays 123 and 124 and the power source wires VSSa and VSSb of the ground potential are provided separately and independently. Or in contrast, the configuration may be such that the power source wire Vssc of the ground potential is commonly provided in both arrays, and the power source wires VDDa and VDDb are provided separately. In both cases, similar to the third embodiment and sixth embodiment, stability of the power source potential and the output signals can be ensured.

Twelfth Embodiment

Figure 13:
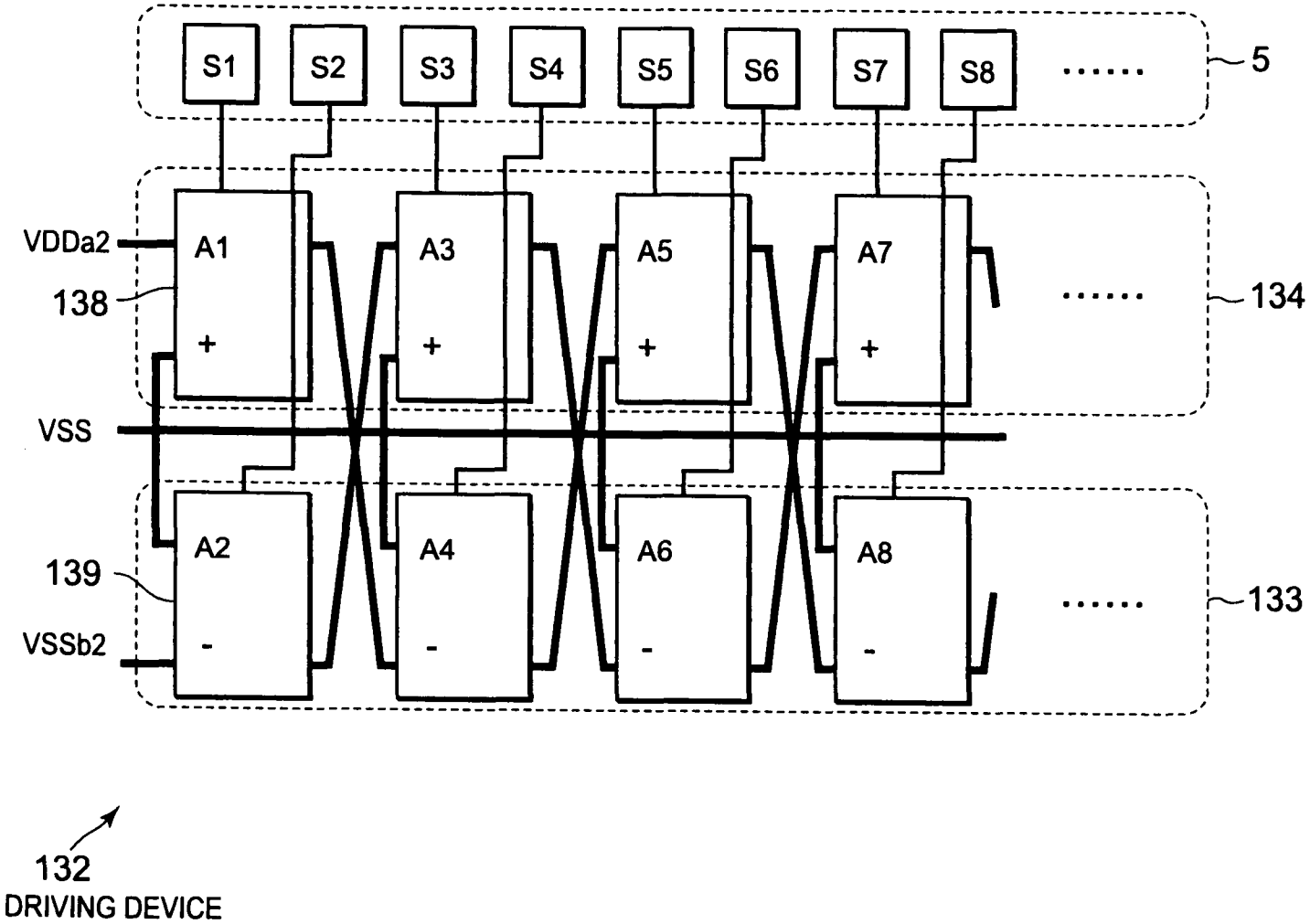
FIG. 13 is a block diagram of a driving device of the rail-to-rail amplifier type according to the twelfth embodiment.

FIG. 13 is a drawing showing a schematic configuration of a driving device 132 in a twelfth embodiment. It differs from the driving device in FIG. 12 in that:

When the amplifiers A1 to A8 corresponding to the output terminals S1 to S8 in this order is divided into two groups, the amplifiers A1, A3, A5, and A7 are adjacently formed in this order to constitute an array 134, and arranged adjacent to the array 5 of the output terminals, and that the amplifiers A2, A4, A6, and A8 are adjacently formed in this order to constitute an array 133, which is arranged adjacent to the array 134. The amplifiers A1, A3, A5, and A7 and the amplifiers A2, A4, A6, and A8 are arranged adjacent to each other in this order in a predetermined direction that is not parallel to the array 5 of the output terminals. Depending on convenience of the layout, the predetermined direction may be orthogonal to the array 5 or slanted rather than being orthogonal. With this configuration, in a case where the inversion driving in FIG. 3 is performed, and when the polarity inversion signal POL is H, polarities of the amplifiers A1, A3, A5, and A7 in the array 134 are −−−− in this order, and polarities of the amplifier A2, A4, A6, and A8 in the array 133 are ++++ in this order. When the polarity inversion signal POL is L, each polarity of the amplifiers are reversed. Thus, each array is a group of the amplifiers that operate with same polarity simultaneously. Then, if the power source wire VDDa2 extends across the both arrays and when the polarity inversion signal is H, for example, out of the array of the positive polarity amplifiers 133, only the amplifiers A4 and A8 are connected thereto, and prevents concentration of currents, thereby preventing potential fluctuations and achieving stability of the output signals. This also applies to the power source wire VDDb2. In addition, the power source wire VDDa2 is commonly connected to the negative polarity amplifiers A1 and A5 simultaneously. Thus, in the driving device 132, it is possible to achieve stability of the output signals while not increasing the number of wires and preventing expansion of the device.

In the driving device 132, similar to FIG. 6, etc., the power source wire VSSc of the ground potential is formed between the arrays 133, 134 of the amplifiers as a common wire. However, the configuration may be such that similar to the power source wires VDDa2 and VDDb2, the two power source wires VSSa2 and VSSb2 are formed independently, and selectively connected to some amplifiers across the arrays 133 and 134.

Here, except for arrangement on the layout of the amplifiers, the driving device 132 is same as each driving device in FIG. 10, FIG. 11 and FIG. 12, in the connection aspect between the power source wires and the amplifiers, and in the connection aspect between the output terminals S1, etc and the amplifiers. The driving method in which polarity changes for every two or more output terminals can also be applied, similar to the configuration described above.

Thirteenth Embodiment

Figure 14:
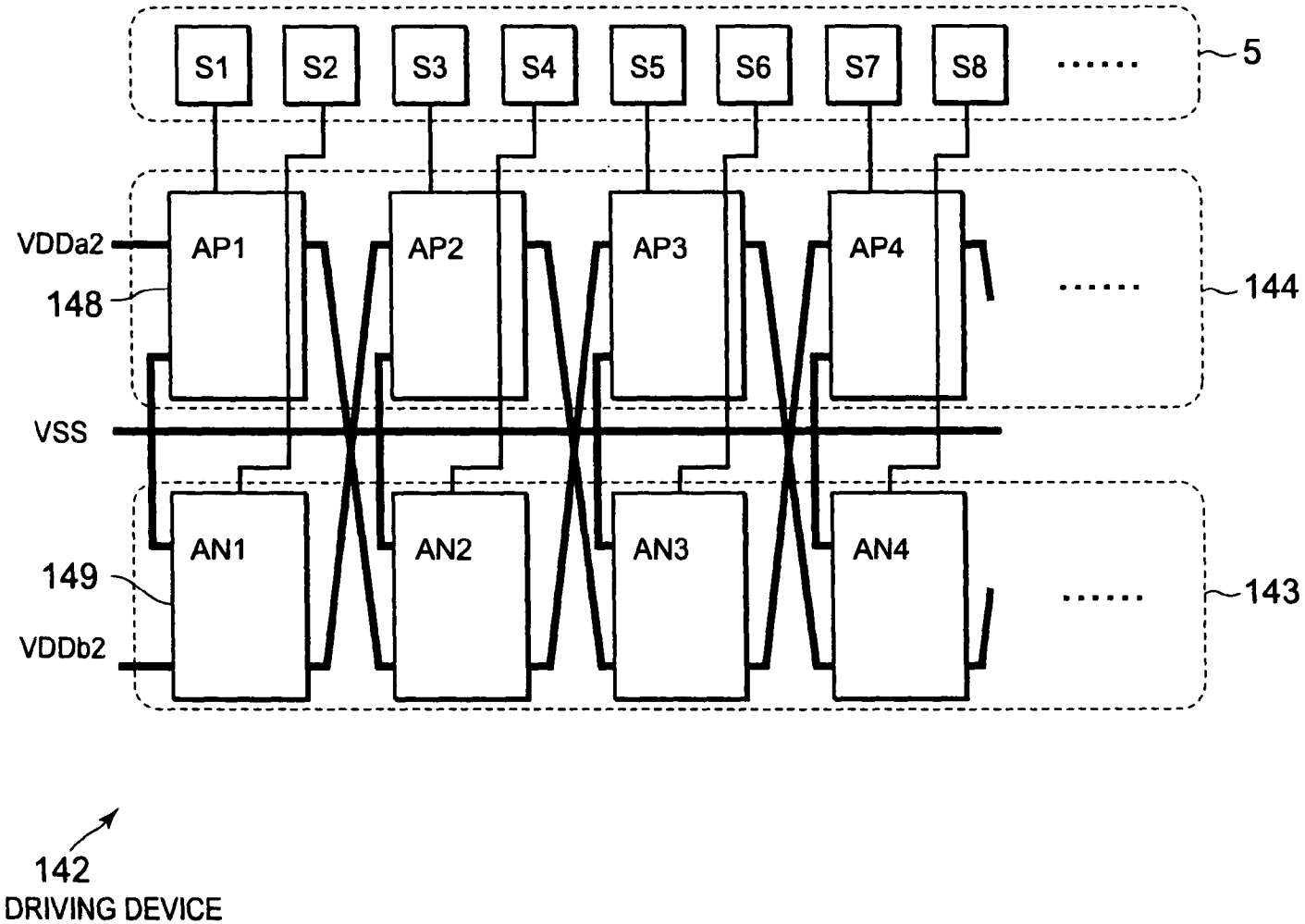
FIG. 14 is a block diagram of a driving device of the rail-to-rail amplifier type according to the thirteenth embodiment.

FIG. 14 is a schematic drawing showing a thirteenth embodiment. A driving device 142 in this embodiment is of P/N buffer amplifier type, the amplifier AP1 to AP4 for positive polarity voltage constituting an array 144, and the amplifier AN1 to AN4 for negative polarity voltage constituting an array 143. The configuration of the power source wires VDDa2 and VDDb2 is similar to the driving device in FIG. 13. This configuration can also prevent concentration of currents onto power source wires, thereby preventing potential fluctuations and implementing stable output signals. In addition, since the power source wires commonly connect the amplifiers that do not become same polarity simultaneously, it is possible to achieve the effects similar to the twelfth embodiment, namely, to implement stability of output signals while preventing expansion of the device.

What is claimed is:

1. A drive circuit, comprising:

a plurality of first output circuits that output signals of one polarity;

a plurality of second output circuits that output signals of another polarity;

a power source wire that connects power terminals of some of the first output circuits and power terminals of some of the second output circuits, wherein the some of the first output circuits comprise the first output circuits belonging to a first group;

wherein the some of the second output circuits comprise the second output circuits belonging to the first group;

wherein the power source wire comprises a first power source wire;

wherein the plurality of the first output circuits include first output circuits belonging to a second group that is different from the first group, and wherein the plurality of the second output circuits include second output circuits belonging to the second group that is different from the first group;

a second power source wire that connects power terminals of the first output circuits of the second group and power terminals of the second output circuits of the second group, and that is different from the first power source wire, wherein the first output circuits of the first group and the second output circuits of the first group are arranged in a first direction to constitute a first array, wherein the first output circuits of the second group and the second output circuits of the second group are arranged in the first direction to constitute a second array, and wherein the first array and the second array are arranged adjacent to each other in a second direction that is different from the first direction; and a plurality of output terminals that respectively receive outputs of the plurality of the first output circuits and outputs of the plurality of the second output circuits, wherein the output terminals are arranged in the first direction to constitute a third array, wherein the first, the second and the third arrays are adjacently arranged to each other in this order in the second direction, wherein when a first, a second, a third and a fourth output circuits are assumed to denote some of the first and the second output circuits respectively corresponding to a first, a second, a third and a fourth output terminals, which are arranged adjacent to each other in this order, out of the output terminals, one even-numbered circuit and one odd-numbered circuit of the first to fourth output circuits are included in the first array, and another even-numbered circuit and another odd-numbered circuit of the first to fourth output circuits are included in the second array.

2. The drive circuit according to claim 1, wherein the power terminal of each of the first output circuits comprises a first power terminal, and wherein each of the first output circuits further includes a second power terminal that is different from the first power terminal, the drive circuit further comprising a third power source wire that commonly connects the second power terminals of at least some of the first output circuits of the first group and the second power terminals of at least some of the first output circuits of the second group.

3. The drive circuit according to claim 1, wherein the first output circuits output signals of the one polarity at a first operation timing, and also output signals of the other polarity at a second operation timing that is different from the first operation timing, and wherein the second output circuits output signals of the other polarity at the first operation timing, and also output signals of the one polarity at the second timing.

4. The drive circuit according to claim 1, wherein one of the plurality of the first output circuits in the first array and one of the plurality of the first output circuits in the second array are arranged adjacent to each other in the second direction.

5. The drive circuit according to claim 1, wherein one of the plurality of the first output circuits in the first array and one of the plurality of the second output circuits in the second array are arranged adjacent to each other in the second direction.

6. The drive circuit according to claim 1, wherein the output terminals form a terminal group for every n terminals (n is a natural number) that are arranged adjacent to each other, wherein the output terminals in one terminal group correspond to the output signals of any one of the one and the other polarities, and wherein adjacent two terminal groups respectively correspond to output signals of different polarities.

7. The drive circuit according to claim 1, wherein the first and the second output circuits are included in any one of the first and the second arrays, and wherein the third and the fourth output circuits are included in another of the first and the second arrays.

8. The drive circuit according to claim 1, wherein the first and the fourth output circuits are included in the first array, wherein the second and the third output circuits are included in the second array, and wherein the first and the second output circuits are arranged adjacent to each other in the second direction.

9. The drive circuit according to claim 1, wherein the first and the fourth output circuits are included in the first array, wherein the second and the third output circuits are included in the second array, and wherein the first and the second output circuits are not arranged adjacent to each other in the second direction.

10. The drive circuit according to claim 1, wherein the first and the fourth output circuits are included in the second array, wherein the second and the third output circuits are included in the first array, and wherein the first and the second output circuits are not arranged adjacent to each other in the second direction.

11. The drive circuit according to claim 1, wherein the first and the third output circuits output the output signal of the one polarity at a first operation timing, and output the output signal of the other polarity at a second operation timing, and wherein the second and the fourth output circuits output the output signal of the other polarity at the first operation timing, and output the output signal of the one polarity at the second operation timing.

12. The drive circuit according to claim 1, wherein the first power source wire extends along the first array, and wherein the second power source wire extends along the second array.

* * * * *